US010094598B2

(12) United States Patent
Burns et al.

(10) Patent No.: US 10,094,598 B2
(45) Date of Patent: Oct. 9, 2018

(54) SYSTEM AND METHOD FOR CONTROLLING MULTI-ZONE VAPOR COMPRESSION SYSTEM

(71) Applicant: Mitsubishi Electric Research Laboratories, Inc., Cambridge, MA (US)

(72) Inventors: Daniel J Burns, Wakefield, MA (US); Junqiang Zhou, Columbus, OH (US); Claus Danielson, Somerville, MA (US); Stefano Di Cairano, Somerville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 184 days.

(21) Appl. No.: 15/174,377

(22) Filed: Jun. 6, 2016

(65) Prior Publication Data

US 2017/0350625 A1 Dec. 7, 2017

(51) Int. Cl.
*F25B 49/02* (2006.01)
*F25B 13/00* (2006.01)

(52) U.S. Cl.
CPC ..... *F25B 13/00* (2013.01); *F25B 49/02* (2013.01); *F25B 2313/029* (2013.01); *F25B 2313/02331* (2013.01)

(58) Field of Classification Search
CPC .... F25B 13/00; F25B 49/02; F25B 2313/023; F25B 2313/0232; F25B 2313/02321; F25B 2313/02322; F25B 2313/02323; F25B 2313/0233; F25B 2313/02331;
(Continued)

(56) References Cited

U.S. PATENT DOCUMENTS 5,007,245 A 4/1991 Defenbaugh et al.
7,331,191 B2 2/2008 He et al.
(Continued)

FOREIGN PATENT DOCUMENTS

EP 2469201 A3 1/2013
WO 2014172374 A1 10/2014
(Continued)

*Primary Examiner* — Jonathan Bradford
(74) *Attorney, Agent, or Firm* — Gene Vinokur; James McAleenan; Hironori Tsukamoto

(57) ABSTRACT

A system controls a multi-zone vapor compression system (MZ-VCS). The system includes a controller to control a vapor compression cycle of the MZ-VCS using a set of control inputs determined by optimizing a cost function including a set of control parameters. The optimizing is subject to constraints, and wherein the cost function is optimized over a prediction horizon. The system also includes a memory to store an optimization function parameterized by a configuration of the MZ-VCS defining active or inactive modes of each heat exchanger, the optimization function modifies, according to a current configuration, values of the control parameters of the cost function determined for a full configuration that includes all heat exchangers in the active mode. The system also includes a processor to determine the current configuration of the MZ-VCS and to update the cost function by submitting the current configuration to the optimization function.

17 Claims, 10 Drawing Sheets

(58) Field of Classification Search
CPC .. F25B 2313/02332; F25B 2313/02333; F25B 2313/02334; F25B 2313/029
See application file for complete search history.

(56) References Cited

U.S. PATENT DOCUMENTS

| | | | | |
|---|---|---|---|---|
| 8,376,242 | B1 * | 2/2013 | Uselton | G05D 23/1905 236/51 |
| 2013/0085614 | A1 * | 4/2013 | Wenzel | G05D 23/1923 700/277 |
| 2015/0267932 | A1 * | 9/2015 | Kim | F24F 11/001 62/98 |
| 2015/0378373 | A1 | 12/2015 | Sprinkle et al. | |

FOREIGN PATENT DOCUMENTS

| | | | |
|---|---|---|---|
| WO | 2016025802 | A1 | 2/2016 |
| WO | 2017018497 | A1 | 2/2017 |

* cited by examiner

SYSTEM AND METHOD FOR CONTROLLING MULTI-ZONE VAPOR COMPRESSION SYSTEM

FIELD OF THE INVENTION

This invention relates to vapor compression systems, and more particularly to a system and a method for controlling a multiple-zone vapor compression system.

BACKGROUND OF THE INVENTION

Vapor compression systems (VCS) move thermal energy between a low temperature environment and a high temperature environment in order to perform cooling or heating operations so that the comfort of the occupants in an indoor space can be maintained or improved. For example, heat can be moved from an indoor space to an outdoor space in order to lower the indoor temperature or mitigate the effect of thermal energy infiltrating an indoor space in a cooling operation. Conversely, heat can be moved from an outdoor space to an indoor space in order to raise the indoor temperature or mitigate the effect of thermal energy exfiltration an indoor space in a heating operation.

A multi-zone vapor compression system (MZ-VCS) includes at least a single compressor and single outdoor heat exchanger connected to multiple indoor heat exchangers arranged in one or more indoor zones. Refrigerant flow is split among the heat exchangers and modulated with flow metering valves arranged between the indoor heat exchangers and outdoor heat exchanger. These flow metering valves can also serve as the main pressure reducing device required to lower the refrigerant temperature and pressure in order to complete the vapor compression cycle. Depending on the state of a four-way valve connected to the compressor, high pressure refrigerant can flow from the compressor to the outdoor unit (in which case the outdoor unit heat exchanger is a condenser and the indoor heat exchangers are evaporators) or refrigerant can flow from the compressor to the heat exchangers and the roles of the indoor and outdoor heat exchangers are reversed.

Recent advancements in power electronics and low cost micro-controllers have led to variable speed compressors, electronically controlled valves, and variable speed fans. The control of these actuators must be coordinated to achieve zone temperature regulation, minimize energy consumption and enforce machine limitations such as a maximum safe pressure of the refrigerant or a maximum safe temperature of a system component.

There is a need to control the overall operations of the MZ-VCS such that various constraints are enforced. For example, certain maximum or minimum temperatures and pressures should not be violated for equipment safety. Some controllers enforce the constraints reactively, i.e., corrective action is taken once a dangerous situation is detected. In this strategy, the violations of the constraints can occur for some period of time while the controller issues corrective actions, and therefore the threshold at which corrective action is initiated is selected conservatively to account for the violations that are likely to occur. And since the operating regime of the highest system performance is often near the constraints, controllers with reactive constraint management that are designed to operate away from the the constraints sacrifice the regions of highest performance, see, e.g., EP2469201.

One important requirement specific to multi-zone systems is the ability to deactivate one or more heat exchangers while remaining heat exchangers continue to provide service. An inactive heat exchanger is characterized by an associated expansion valve that is closed, which ceases refrigerant flow through the heat exchanger thereby preventing heat exchange with the corresponding zone. Additionally, the control objective of regulating the air temperature to a setpoint is not applicable in zones wherein the heat exchanger is inactive. The specific combination of active and inactive heat exchangers is called the system configuration or just a configuration. In commercial MZ-VCS it is common to have 50 heat exchangers connected to an outdoor unit, creating $2^{50}=1.1\times10^{15}$ possible configurations. When a heat exchanger changes from an active state to an inactive state, the MZ-VCS is said to have been reconfigured, and a system that permits reconfiguration is said to be reconfigurable.

Accordingly, there is a need in the art for a system and a method to control every possible configuration of a reconfigurable MZ-VCS that is subject to constraints.

SUMMARY OF THE INVENTION

It is an object of some embodiments of the invention to provide a system and a method for controlling operations of a multi-zone vapor compression system (MZ-VCS). It is another object of some embodiments of the invention to provide a system and method for controlling the vapor compression system predictively using a model of the system dynamics to determine and solve an optimization problem such that constraints on the operation of the MZ-VCS are enforced. It is another object of some embodiments to control the operation of a MZ-VCS where zones are permitted to become active or inactive. Further, it is an object of some embodiments that the controller can be modified online to adapt to the specific machine configuration, that is, the specific combination of heat exchangers that are active and inactive.

Predictive control, e.g., a model predictive control (MPC), is based on an iterative, finite horizon optimization of a cost function that describes the operation of the controlled system and has the ability to predict the MZ-VCS response to current conditions and take appropriate control actions. Further, constraints can be included in the formulation of this optimization problem. Some embodiments of the invention are based on recognition that MPC offers attractive properties for vapor compression system control including guaranteed enforcement of constraints. Because constraint enforcement can be guaranteed, selection of more aggressive constraints can lead to higher performance such as faster room temperature responses or safe operation over a wider range of outdoor air conditions.

MPC solves an optimization problem that encodes information about how changes in every zone affect the control objectives. Because deactivating a zone fundamentally changes the structure of the optimization problem, different optimization problems specific to every system configuration need to be specified, but manually specifying an optimization problem for every configuration is not practical for the large number of possible configurations. Further, the sets of different controller parameters encoding the different optimization problems would all need to be available at runtime, requiring significantly more memory for parameter storage than is typically available for embedded hardware.

However, it is realized that a structured model describing the dynamics of a MZ-VCS can be obtained that reveals the specific coupling inherent to MZ-VCS. Specifically, some embodiments are based on understanding that while the changes due to the outdoor unit components affect every heat exchanger, and each heat exchanger affects the outdoor unit, the specific heat exchangers largely do not affect each other. This type of coupling results in a dynamic model that exhibits a particular structure—that is, the system of equations describing the MZ-VCS dynamics from control inputs to measurements, when collected in matrix form, results in a specific pattern of zero-valued and non-zero-valued elements within the matrices.

It is further realized that by exploiting this pattern, an optimization problem can be formulated and parameterized by the system configuration, and, given the system configuration, an optimization problem specific to the given configuration can be automatically obtained. Further, the closed loop stability resulting from the use of any specific optimization problem can be guaranteed by further exploiting the model structure to compute structured controller parameters. In this manner, a reconfigurable control system is developed that retains the constraint enforcement advantages of MPC, stable for any configuration, and does so without the burden of manually specifying different optimization problems for every system configuration.

Accordingly, one embodiment discloses a system for controlling a multi-zone vapor compression system (MZ-VCS) including a compressor connected to a set of heat exchangers for controlling environments in a set of zones. The system comprises a controller to control a vapor compression cycle of the MZ-VCS using a set of control inputs determined by optimizing a cost function including a set of control parameters, wherein the optimizing is subject to constraints, and wherein the cost function is optimized over a prediction horizon; a memory to store an optimization function parameterized by a configuration of the MZ-VCS defining active or inactive modes of each heat exchanger, wherein the optimization function modifies values of the control parameters of the cost function according to the configuration; and a processor to determine a current configuration of the MZ-VCS and to update the cost function by submitting the current configuration to the optimization function.

Another embodiment discloses a method for controlling a multi-zone vapor compression system (MZ-VCS) including a compressor connected to a set of heat exchangers for controlling environments in a set of zones. The method includes determining a current configuration of the MZ-VCS defining active or inactive mode of each heat exchanger in the MZ-VCS; updating at least some values of control parameters in a cost function by submitting the current configuration to an optimization function parameterized by a configuration of the MZ-VCS, wherein the optimization function modifies values of the control parameters of the cost function according to the current configuration; and controlling a vapor compression cycle of the MZ-VCS using a set of control inputs determined by optimizing the cost function subject to constraints. Steps of the method are performed using a processor.

Yet another embodiment discloses a non-transitory computer readable storage medium embodied thereon a program executable by a processor for performing a method. The method includes determining a current configuration of the MZ-VCS defining active or inactive mode of each heat exchanger in the MZ-VCS; updating at least some values of control parameters in a cost function by submitting the current configuration to an optimization function parameterized by a configuration of the MZ-VCS, wherein the optimization function modifies values of the control parameters of the cost function according to the current configuration; and controlling a vapor compression cycle of the MZ-VCS using a set of control inputs determined by optimizing the cost function subject to constraints.

DEFINITIONS

In describing embodiments of the invention, the following definitions are applicable throughout (including above).

A "computer" refers to any apparatus that is capable of accepting a structured input, processing the structured input according to prescribed rules, and producing results of the processing as output. Examples of a computer include a general-purpose computer; a supercomputer; a mainframe; a super mini-computer; a mini-computer; a workstation; a microcomputer; a server; an interactive television; a hybrid combination of a computer and an interactive television; and application-specific hardware to emulate a computer and/or software. A computer can have a single processor or multiple processors, which can operate in parallel and/or not in parallel.

A computer also refers to two or more computers connected together via a network for transmitting or receiving information between the computers. An example of such a computer includes a distributed computer system for processing information via computers linked by a network.

A "central processing unit (CPU)" or a "processor" refers to a computer or a component of a computer that reads and executes software instructions.

A "memory" or a "computer-readable medium" refers to any storage for storing data accessible by a computer. Examples include a magnetic hard disk; a floppy disk; an optical disk, like a CD-ROM or a DVD; a magnetic tape; a memory chip; and a carrier wave used to carry computer-readable electronic data, such as those used in transmitting and receiving e-mail or in accessing a network, and a computer memory, e.g., random-access memory (RAM).

"Software" refers to prescribed rules to operate a computer. Examples of software include software; code segments; instructions; computer programs; and programmed logic. Software of intelligent systems may be capable of self-learning.

A "module" or a "unit" refers to a basic component in a computer that performs a task or part of a task. It can be implemented by either software or hardware.

A "control system" refers to a device or a set of devices to manage, command, direct or regulate the behavior of other devices or systems. The control system can be implemented by either software or hardware, and can include one or several modules.

A "computer system" refers to a system having a computer, where the computer comprises computer-readable medium embodying software to operate the computer.

A "network" refers to a number of computers and associated devices that are connected by communication facilities. A network involves permanent connections such as cables, temporary connections such as those made through telephone or other communication links, and/or wireless connections. Examples of a network include an internet, such as the Internet; an intranet; a local area network (LAN); a wide area network (WAN); and a combination of networks, such as an internet and an intranet.

A "vapor compression system" refers to a system that uses a vapor compression cycle to move refrigerant through components of the system based on principles of thermodynamics, fluid mechanics, and/or heat transfer.

An "HVAC" system refers to any heating, ventilating, and air-conditioning (HVAC) system implementing the vapor compression cycle. HVAC systems span a very broad set of systems, ranging from systems which supply only outdoor air to the occupants of a building, to systems which only control the temperature of a building, to systems which control the temperature and humidity.

"Components of a vapor compression system" refer to any components of the vapor compression system having an operation controllable by the control systems. The components include, but are not limited to, a compressor having a variable speed for compressing and pumping the refrigerant through the system; an expansion valve for providing an adjustable pressure drop between the high-pressure and the low-pressure portions of the system, and an evaporating heat exchanger and a condensing heat exchanger, each of which may incorporate a variable speed fan for adjusting the air-flow rate through the heat exchanger.

An "evaporator" refers to a heat exchanger in the vapor compression system in which the refrigerant passing through the heat exchanger evaporates over the length of the heat exchanger, so that the specific enthalpy of the refrigerant at the outlet of the heat exchanger is higher than the specific enthalpy of the refrigerant at the inlet of the heat exchanger, and the refrigerant generally changes from a liquid to a gas. There may be one or more evaporators in the vapor-compression system.

A "condenser" refers to a heat exchanger in the vapor compression system in which the refrigerant passing through the heat exchanger condenses over the length of the heat exchanger, so that the specific enthalpy of the refrigerant at the outlet of the heat exchanger is lower than the specific enthalpy of the refrigerant at the inlet of the heat exchanger, and the refrigerant generally changes from a gas to a liquid. There may be one or more condensers in a vapor-compression system.

A "setpoint" refers to a target value the system, such as the vapor compression system, aims to reach and maintain as a result of the operation. The term setpoint is applied to any particular value of a specific set of control signals and thermodynamic and environmental parameters.

"Heat load" refers to the thermal energy rate moved from a low temperature zone to a high temperature zone by the vapor compression system. The units typically associated with this signal are Joules per second or Watts or British Thermal Units per hour (BTUs/hr).

"Thermal capacity" refers to the energy rate absorbed by a heat exchanger in a vapor compression system. The units typically associated with this signal are Joules per second or Watts or British Thermal Units per hour (BTUs/hr).

"System configuration" or a "configuration" refers to the specific combination of activated heat exchangers and inactivated heat exchangers in a multi-zone vapor compression system.

An "active" heat exchanger is a heat exchanger for which the associated expansion valve is opened, allowing refrigerant to enter the heat exchanger. Conversely, an "inactive" heat exchanger is a heat exchanger for which the associated expansion valve is closed, preventing refrigerant from entering the heat exchanger.

DETAILED DESCRIPTION OF EMBODIMENTS OF THE INVENTION

A multi-zone vapor compression system (MZ-VCS) of some embodiments of the invention includes an ability to deactivate one or more heat exchangers while the remaining heat exchangers continue to provide service. For instance, an occupant may anticipate that a zone in a space is unoccupied and can shut off the heat exchanger in order to reduce energy consumption by not conditioning the air in the occupied space. In this case, the decision to deactivate a zone and the corresponding heat exchanger is determined by a source external (the occupant) to the MZ-VCS controller.

Additionally or alternatively, in one embodiment, the MZ-VCS controller can determine that the local heating or cooling loads in a particular zone are lower than the minimum continuously available amount of heating or cooling provided by the heat exchanger and can automatically deactivate the heat exchanger. In this case, the MZ-VCS controller itself has determined that a particular zone is to be deactivated. In either case, a deactivated heat exchanger is characterized by an associated expansion valve that is closed, and therefore no refrigerant flows through the heat exchanger. Additionally, the control objective of regulating the air temperature to a setpoint is no longer applicable in zones wherein the heat exchanger has become deactivated.

To that end, various embodiments describe a system and method for controlling the operations of a multi-zone vapor compression system where individual zones are permitted to be activated or deactivated. In some embodiments, a controller for determining the actuator commands and/or setpoints to inner feedback capacity controllers is implemented according to the principles of model predictive control (MPC) wherein determining the actuator commands involves solving a receding horizon constrained optimization problem. The optimization problem includes a prediction model of the dynamics of the MZ-VCS and a cost function that is to be optimized. The cost function includes penalty matrices that encode the desired closed loop performance of the system and guarantee dynamic stability.

A configuration of the MZ-VCS defines active or inactive modes of each heat exchanger. Deactivating zones changes the configuration and implies that the control inputs in the associated deactivated zone are not to be used and control objectives in the associated deactivated zone are not to be considered. Such a removal of the control inputs and change in the control objective fundamentally modifies the relevant optimization problem. Preparing an appropriate optimization problem for a system that undergoes such fundamental structural changes is achieved with one or a combination of an offline preparation of the control parameters of the cost function to be optimized and online modification of the control parameters in response to a change of the configuration of the MZ-VCS.

Figure 1A:
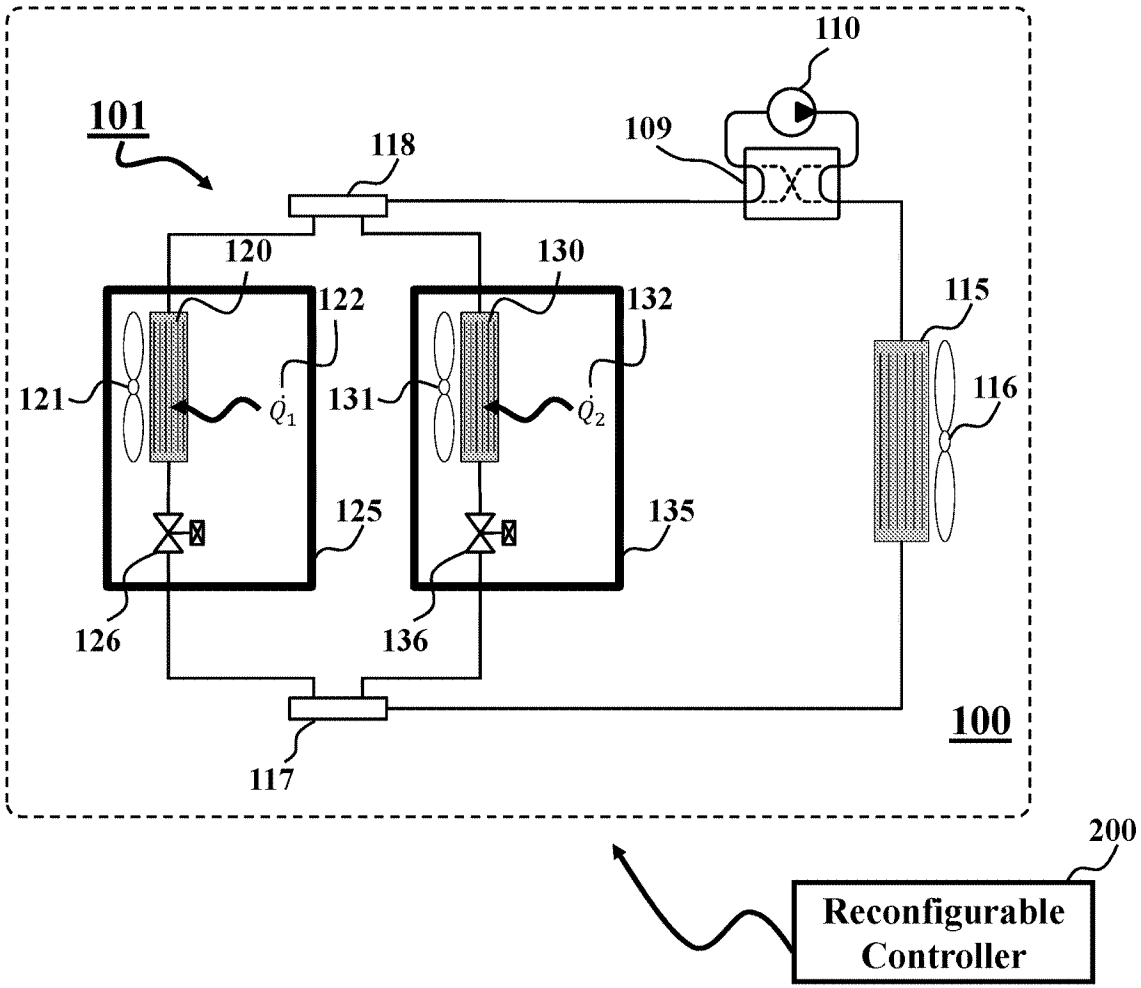
FIGS. 1A and 1B are block diagrams of a multi-zone vapor compression system (MZ-VCS) controlled according to principles employed by some embodiments of an invention.
Figure 1B:
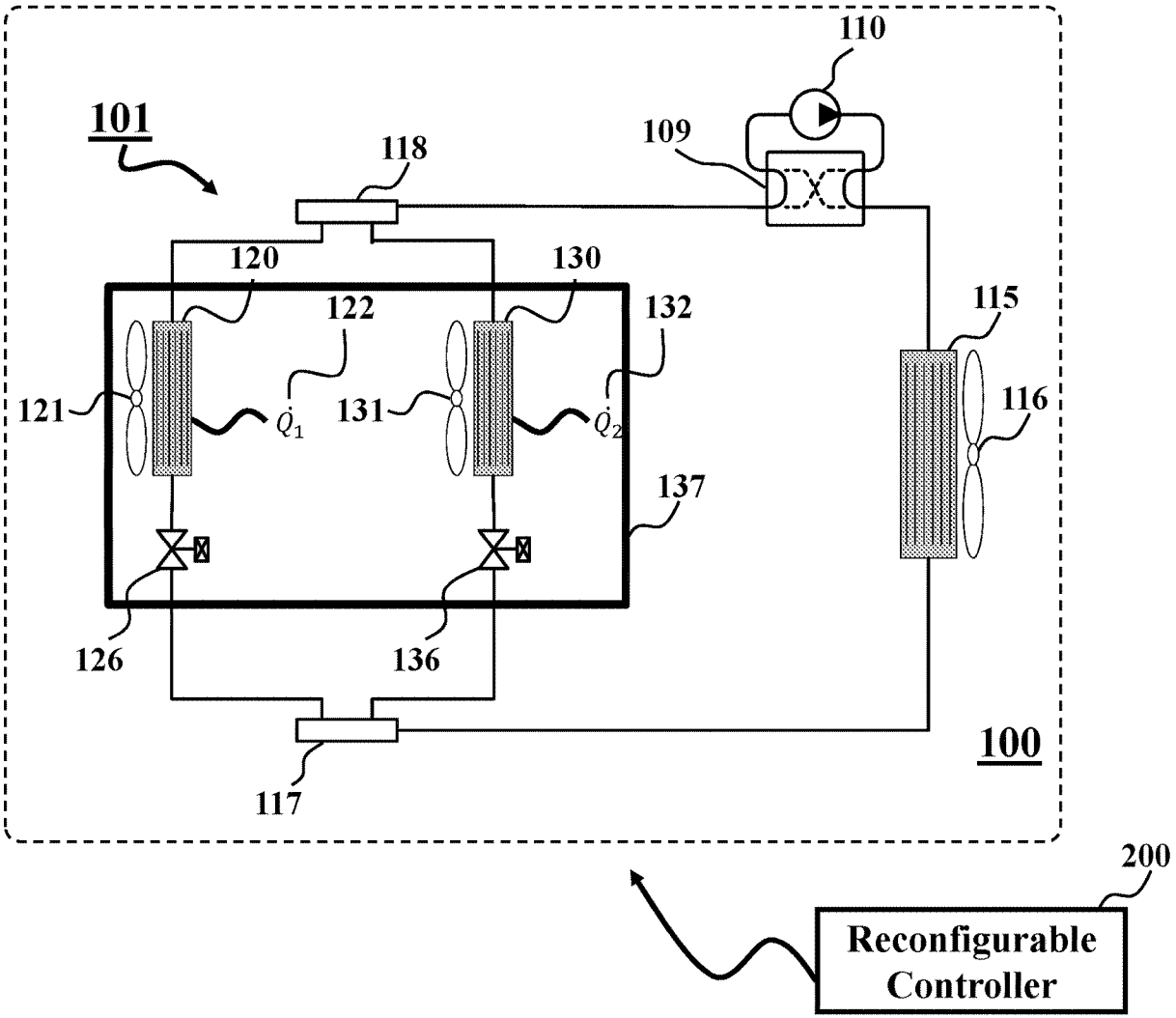

FIGS. 1A and 1B show block diagrams of a multi-zone vapor compression system (MZ-VCS) 100 controlled by a controller 101 according to principles employed by some embodiments of the invention. The MZ-VCS includes a compressor and a set of heat exchangers configured for controlling environments in a set of zones. There is at least one heat exchanger for each zone. For example, in one embodiment of FIG. 1A, each zone 125 or 135 corresponds to a room in a building enabling the MZ-VCS to provide cooling or heating to multiple zones simultaneously. In an alternative embodiment shown in FIG. 1B, multiple heat exchangers are placed in one room or zone 137 in a building enabling the MZ-VCS to provide cooling or heating to different sections of the room.

In this disclosure, a two-zone MZ-VCS is depicted and described for clarity, but it should be understood that any number of zones can be used, subject to the physical limitations of refrigerant line lengths, capacity and pumping power of the compressor, and building codes. If the zone is an indoor zone, such as a room or a portion of the room, the heat exchangers are indoor heat exchangers.

A compressor 110 receives a low-pressure refrigerant in a vapor state and performs mechanical work to increase the pressure and temperature of the refrigerant. Depending on the configuration of a four-way valve 109, the high temperature refrigerant can be routed to either an outdoor heat exchanger (in which case the system moves heat to the outside environment and is providing useful cooling and is said to operate in cooling mode) or to an indoor heat exchanger (in which case the system moves heat to one or more indoor zones and is providing useful heating and is said to operate in heating mode).

For clarity and in order to simplify the subsequent description, a cooling mode is generally considered, i.e., the compressor is connected to the rest of the vapor compression system as shown as solid lines of the four-way valve 109, but it should be understood that analogous statements can be made about the system operating in heating mode with appropriate substitutions, e.g., condenser for evaporator, condensing temperature for evaporating temperature, etc.

In cooling mode, the high-temperature, high-pressure refrigerant moves to an outdoor heat exchanger 115 and in the case of an air-source vapor compression system, an associated optional fan 116 blows air across the heat exchanger, where the air acts as a heat source or sink as shown in FIG. 1A or 1B. In the case of a ground-source vapor compression system, components of outdoor heat exchanger may be buried underground or otherwise in direct contact with earth or water, and in that case, the ground environment acts as a heat source or sink. Heat is transferred from the refrigerant to the environmental heat source or sink, causing the refrigerant in the outdoor heat exchanger to condense from a vapor to a liquid.

The phase change process wherein vapor refrigerant condenses from saturated vapor to a two-phase mixture of both liquid and vapor to saturated liquid is isothermal in ideal descriptions of the vapor compression cycle, that is, the phase change process occurs at a constant temperature and therefore without a sensible change in temperature. However, if further heat is removed from the saturated liquid, the temperature of the saturated liquid then decreases by some amount and the refrigerant is termed "subcooled." The subcool temperature is the temperature difference between the subcooled refrigerant and the calculated saturated liquid refrigerant temperature at the same pressure.

Liquid high temperature refrigerant exits the outdoor heat exchanger and is split by a manifold 117 in order to distribute the refrigerant between the subsequently connected indoor zones 125, 135 or 137. Separate expansion valves 126, 136 are connected to the inlet manifold. These expansion valves are restriction elements and cause the pressure of the refrigerant to be substantially reduced. Since the pressure is reduced without substantial heat exchange in the valve, the temperature of the refrigerant is substantially reduced, termed "adiabatic" in ideal descriptions of the vapor compression cycle. The resulting refrigerant exiting the valves is a low pressure, low temperature two-phase mixture of liquid and vapor.

Two-phase refrigerant enters the indoor heat exchangers 120, 130 where associated fans 121, 131 move air across the heat exchangers. Heat 122, 132 representing the thermal loads from the indoor spaces is transferred from the zones to the refrigerant, causing the refrigerant to evaporate from a two-phase mixture of liquid and vapor to a saturated vapor state.

The phase change process wherein refrigerant evaporates from a saturated vapor to a two-phase mixture of both liquid and vapor to saturated vapor is isothermal in ideal descriptions of the vapor compression cycle, i.e., occurs at a constant temperature and therefore is a process that occurs without a sensible change in temperature. However, if further heat is added to the saturated vapor, the temperature of the saturated vapor then increases by some amount and the refrigerant is termed "superheated." The superheat temperature is the difference between the superheated refrigerant vapor and the calculated saturated vapor temperature at the same pressure.

The low pressure refrigerant vapor exiting the heat exchangers is rejoined to a common flow path at the outlet manifold 118. Finally, low pressure refrigerant vapor is returned to the compressor and the cycle repeats.

In some embodiments of the invention, the MZ-VCS is controlled by a controller 200. For example, the controller 200 solves an optimization problem that encodes information about how changes in every zone affect the control objectives. Because deactivating a zone fundamentally changes the structure of the optimization problem, different optimization problems specific to every system configuration need to be specified.

The controller 200 is a predictive controller, such as MPC. Some embodiments are based on realization that it is possible to determine a structured model of the MZ-VCS describing the dynamics of the MZ-VCS, which reveals the specific coupling among the components of the MZ-VCS. Specifically, some embodiments are based on understanding that while the changes due to the outdoor unit components affect every heat exchanger, and each heat exchanger affects the outdoor unit, the specific heat exchangers largely do not affect each other. This type of coupling results in a dynamic model that exhibits a particular structure—that is, the system of equations describing the MZ-VCS dynamics from control inputs to measurements, when collected in matrix form, results in a specific pattern of zero-valued and non-zero-valued elements within the matrices. It is further realized that by exploiting this pattern, an optimization problem can be formulated and parameterized by the system configuration, such that, given the system configuration, an optimization problem specific to the given configuration can be automatically obtained. To that end, the controller 200 is a reconfigurable controller.

Figure 1C:
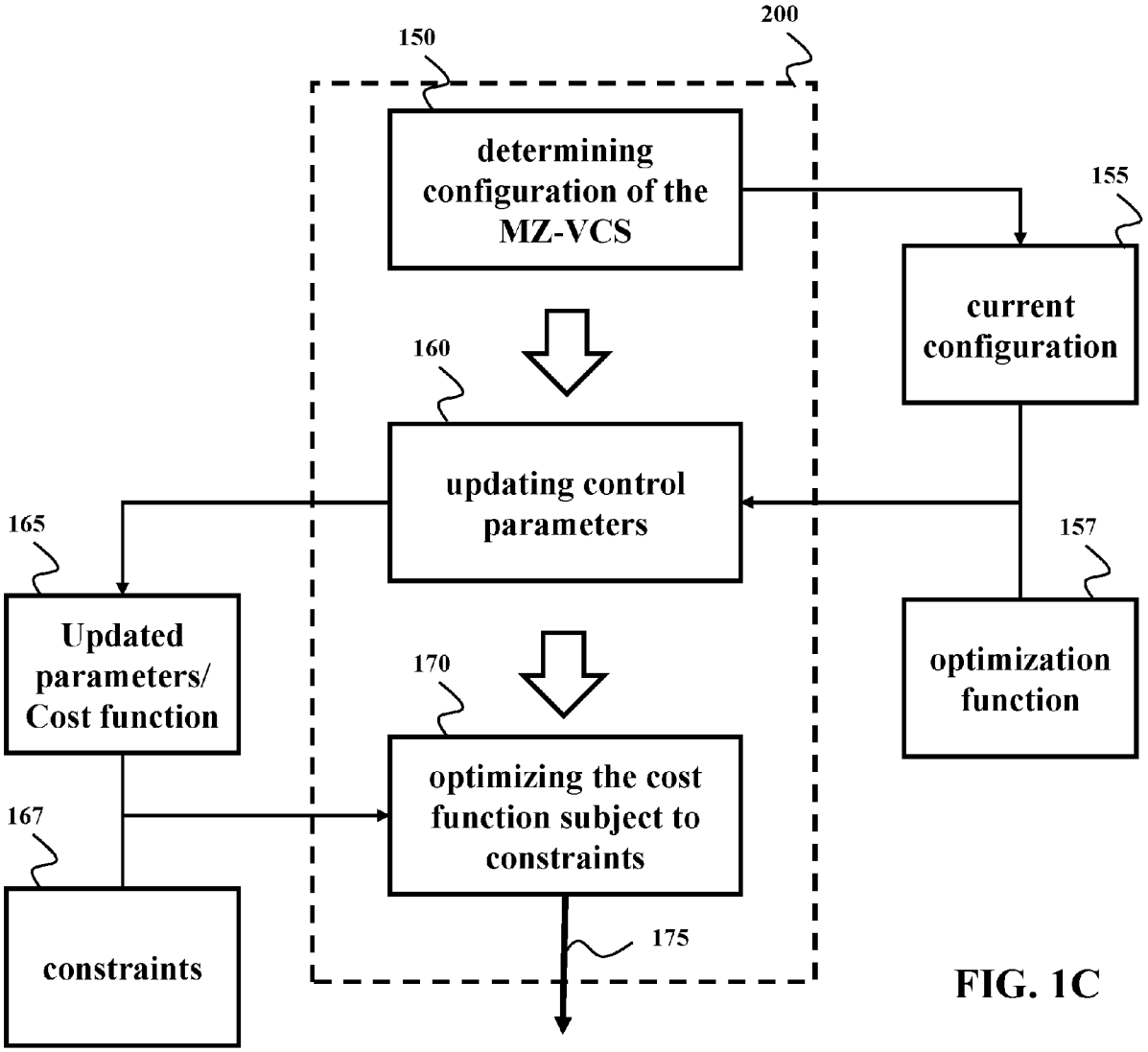
FIG. 1C is a block diagram of a method for controlling a multi-zone vapor compression system (MZ-VCS) according to some embodiments of the invention.

FIG. 1C shows a block diagram of a method for controlling a multi-zone vapor compression system (MZ-VCS) including a compressor connected to a set of heat exchangers for controlling environments in a set of zones according to some embodiments of the invention. The method is performed by the controller 200. For example, the controller 200 can include a processor and a memory for performing steps of the method.

The method determines 150 a current configuration 155 of the MZ-VCS defining active or inactive mode of each heat exchanger in the MZ-VCS and updates 160 at least some values of control parameters in a cost function 165 by submitting the current configuration 155 to an optimization function 157 parameterized by a configuration of the MZ-VCS.

The optimization function modifies, according to a current configuration, values of the control parameters of the cost function determined for a full configuration that includes all heat exchangers in the active mode. For example, a structure of the control parameters can correspond to a structure of a model of the MZ-VCS, such that there is a correspondence between control parameters and a heat exchanger in the MZ-VCS. To that end, in some embodiments, the optimization function preserves the values of the control parameters if the corresponding heat exchanger is in the active mode and modifies the values of the block if the corresponding heat exchanger is in the inactive mode.

For example, the configuration can be a binary vector having elements with a first value, e.g., a zero value, for the heat exchangers in the inactive mode and having elements with a second value, e.g., a non-zero value, for the heat exchangers in the active mode. Such a correspondence can be established if, e.g., an index of the element in the configuration vector matches an index of a corresponding heat exchanger.

For example, due to the coupling structure of the heat exchangers, the control parameters can be defined offline for full configuration of the MZ-VCS as a combination of the block matrices. An index of each block on the diagonal of the matrix matches the index of the corresponding heat exchanger and values of each block on the diagonal of the matrix are determined for the corresponding heat exchanger. For example, the block diagonal matrix can include one or a combination of a performance penalty matrix Q whose elements penalize outputs of the MZ-VCS, a control penalty matrix R whose elements penalize control inputs to the MZ-VCS, and a terminal cost matrix P whose elements penalize terminal states of the MZ-VCS. Upon receiving the current configuration, the objective function 157 replaces the values of the blocks of the performance penalty matrix Q and the terminal cost matrix P with zeros if the corresponding heat exchanger is in the inactive mode, and wherein the optimization function replaces the values of the block of the control penalty matrix R with values larger than initial values of the control penalty matrix if the corresponding heat exchanger is in the inactive mode.

In various embodiments, the optimization function preserves the dimensions of the block diagonal matrix, which in turn, preserves the structure of the updated cost function 165. To that end, some embodiments can optimize the cost function updated, i.e., configured for the specific configuration of the MZ-VCS, subject to constraints 167 to determine a set of control inputs 175 for controlling a vapor compression cycle of the MZ-VCS. For example, the control inputs can be the inputs to one or combination of the compressor 110, the outdoor heat exchanger fan 116, the indoor heat exchanger fans 121, 131 and the expansion valves 126, 136.

Figure 1D:
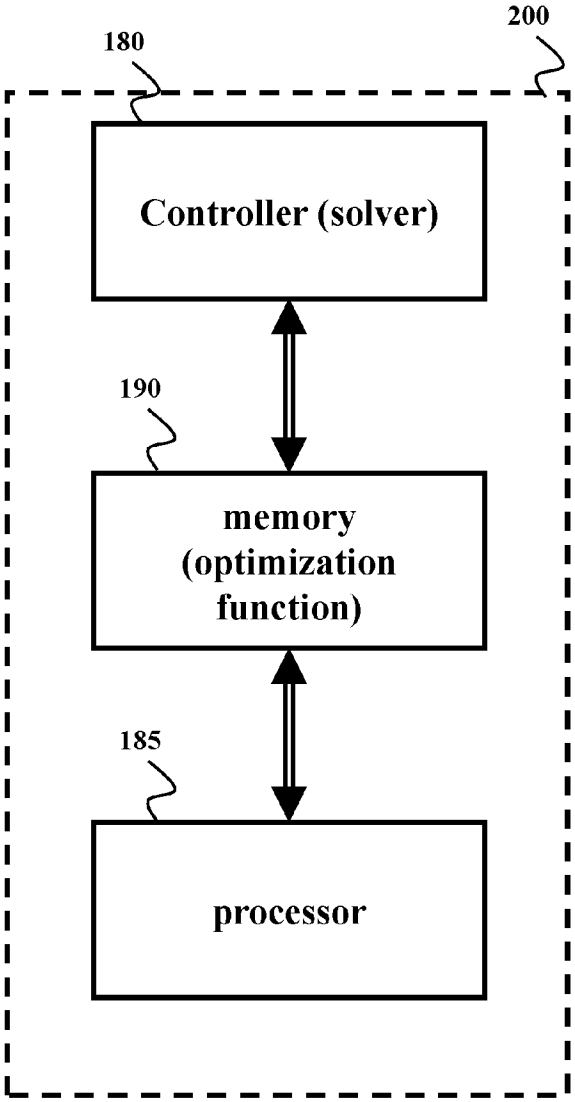
FIG. 1D is an exemplar structure of a reconfigurable controller according to some embodiments of the invention.

FIG. 1D shows an exemplar structure of the reconfigurable controller 200. The controller 200 can include a controller 180, such as one or combination of a supervisory controller described below and a solver for optimizing the cost function 165, to control a vapor compression cycle of the MZ-VCS using the control inputs 175. The controller can be implemented, e.g., using a microprocessor or any other programmable electronic device which accepts digital or binary data as input, processes the input according to instructions stored in its memory, and provides results as output.

Additionally or alternatively, the reconfigurable controller 200 can include a memory 190 to store the optimization function parameterized by a configuration of the MZ-VCS defining active or inactive modes of each heat exchanger, and a processor 185 to determine the current configuration of the MZ-VCS and to update the cost function by submitting the current configuration to the optimization function. In some embodiments, the controller, the memory, and the processor are interconnected to facilitate the operation of the controller 200. For example, the processor 185 can be used to implement some of the functionality of the controller 180. Similarly, the memory 190 can include a non-transitory computer readable storage medium embodied thereon a program executable by a processor for performing the method of FIG. 1C.

Figure 2A:
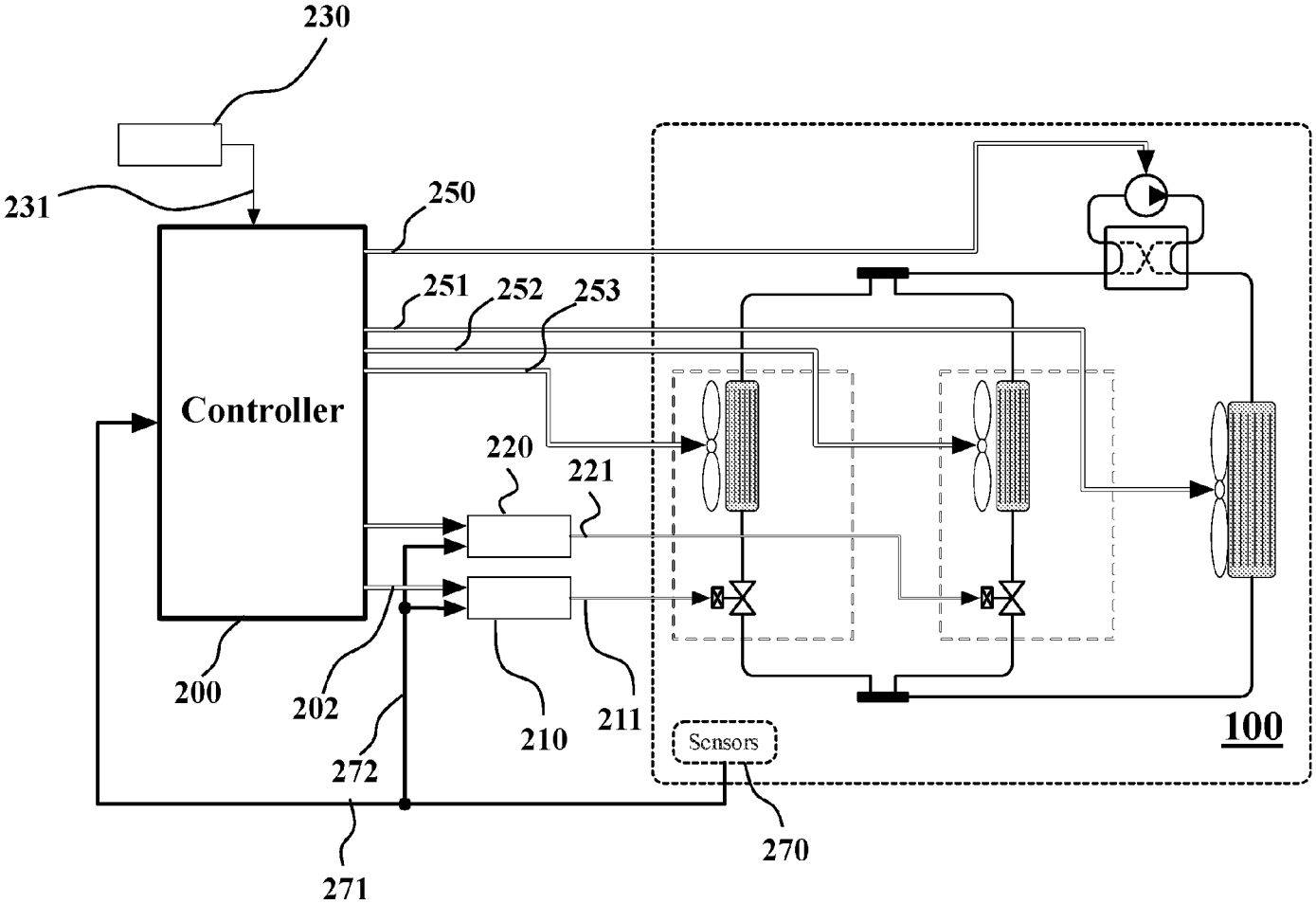
FIG. 2A is a block diagram of a method for controlling the MZ-VCS of FIG. 1A or 1B according to one embodiment of the invention.
Figure 2B:
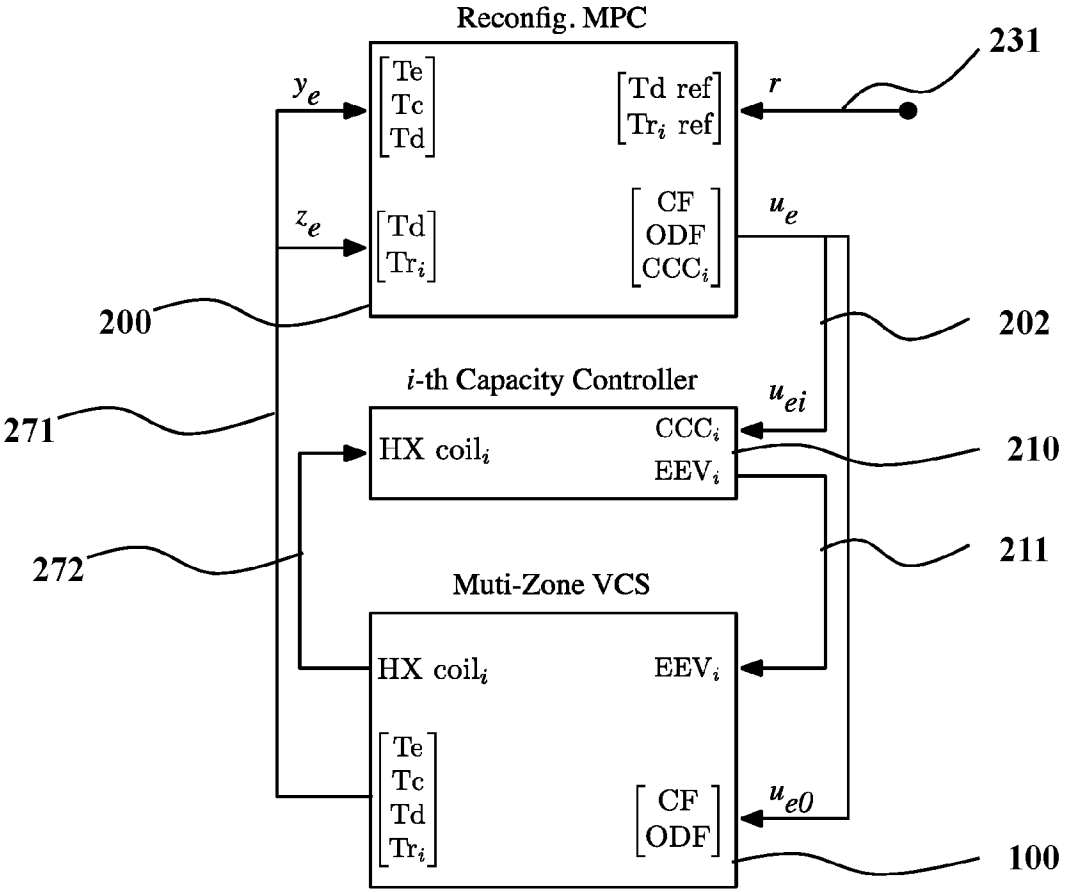
FIG. 2B is a signal diagram for the method of FIG. 2A.

FIG. 2A is a block diagram of a method for controlling the MZ-VCS of FIG. 1A or 1B according to one embodiment of the invention. FIG. 2B is a signal diagram for the method of FIG. 2A. The MZ-VCS 100 is controlled by the reconfigurable controller 200 that determines control inputs forming commands subsequently issued to the actuators of the MZ-VCS. The commands can include a compressor speed command 250, an outdoor unit fan speed command 251, or heat exchanger fan speed commands 252, 253. The heat exchanger fan speed commands may alternatively be determined by the occupants as described below. The reconfigurable controller 200 receives sensor information 271 from sensors 270 arranged at various locations on the system. The spatial arrangement of sensors are not depicted in FIG. 2A for clarity and simplicity, and their precise locations within the system are not pertinent to the invention. Additionally, the controller receives setpoint information 231 from an external source such as an input interface 230 that allows an occupant to enter entering the desired zone temperatures.

In some embodiments, the compressor speed command 250 can be fixed to one or more predetermined settings or can be varied continuously. Similarly, the outdoor heat exchanger fans 116 can operate at fixed speeds or the speeds can be varied continuously. In some configurations, an indoor heat exchanger fan 121, 131 can be determined by the MZ-VCS controller 200, or its speed can be determined by an occupant when the occupant wishes to directly control indoor airflow. In the case an indoor fan speed is determined by the controller, the fan speed is treated by the controller as a control input for manipulating the operation of the system. In the case an indoor fan speed is specified by an occupant, the fan speed is treated by the controller as measured disturbance acting on the system. The expansion valves 126, 136 are controlled by the controller and can vary from a fully closed to a fully open position, including one or more intermediate positions.

In some embodiments, the MZ-VCS replaces electronically-controlled expansion valves with a series combination of a solenoid valve for on/off control, and a separate variable opening valve for precise flowrate control. The control inputs associated with these actuators are the compressor rotational frequency (CF) command 250, the outdoor fan speed (ODF) command 251, and each electronic expansion valve opening position ($EEV_i$) command 211, 221.

Additional disturbances acting on the ME-VCS include the heat load 122, 132 associated with each zone and the outdoor air temperature (OAT). Heat loads are the amount of thermal energy moved from the heat exchangers to the outdoor unit per unit time. The total heat is then rejected to the atmosphere at the outdoor heat exchanger temperature, which is determined by both the OAT (a disturbance signal) and the state of the machine actuators.

The available sensors 270 can include temperature sensors that measure the evaporating temperature Te, the condensing temperature Tc, the compressor discharge temperature Td, and the air temperature $Tr_i$ in each zone, labeled 271 in FIGS. 2A and 2B, or that measure other temperatures, pressures, or flow rates. Additionally, each heat exchanger may include heat exchanger coil temperature sensors (HX coil) that measure the refrigerant temperature at various locations along the heat exchanger, labeled 272 in FIGS. 2A and 2B.

Some embodiments include a reconfigurable controller, such as MPC, and a set of N capacity controllers, as shown in FIGS. 2A and 2B. The capacity controllers 210 receive commands 202 from the MPC that indicate a desired reference cooling capacity, which is the proportional to the desired amount of heat removed from the zone by each evaporator per unit time. The capacity controller 210 determines a command 211 for the EEV position to produce the desired cooling capacity, based on measurements of the coil temperatures (HX coil) 272. These capacity controllers account for the fact that the effect of EEV positions on zone temperatures is nonlinear. The cooling capacity controllers linearize the responses from the reference cooling capacity 202 of each zone $CCC_i$ to the associated zone temperature $Tr_i$.

The combination of the ME-VCS 100 plus the set of capacity controllers 210, 220 is referred herein as the augmented system. When viewed from the perspective of the reconfigurable controller 200, the augmented system is linear and exhibits structure that is exploited for computing MPC controllers for each configuration. Using this approach, the reconfigurable controller is responsible for determining some actuator commands directly, and determines other commands that may be interpreted as setpoints for the capacity controllers.

A heat exchanger associated with an opened or partially opened valve is said to be "active." For valves that are closed, no refrigerant enters the associated heat exchanger and the evaporator is said to be "inactive." As referred herein, the configuration of the MZ-VCS is the combination of heat exchangers that are active and inactive. More formally, for an N-heat exchanger MZ-VCS, using the notation $(x,y):=[x^T\ y^T]^T$, the configuration $\zeta(t):=(\zeta_0(t), \ldots, \zeta_N(t))$ as a vector of binary-valued elements that indicate whether zone i is active ($\zeta_i(t)=1$) or inactive ($\zeta_i(t)=0$) at time t.

The control objectives can include the regulation of each zone temperature $Tr_i$ to an associated reference temperature $Tr_{iref}$ provided by an external source such as an occupant while rejecting disturbances in heat load and outdoor air temperature. Further, one or more machine temperatures indicative of the vapor compression cycle performance may be driven to associated setpoint(s). For example, in some embodiments the compressor discharge temperature is to be driven to a reference $Td_{ref}$ that has been determined for optimal energy efficiency. In other embodiments, evaporator superheat temperature(s) Tesh are to be driven to references $Tesh_{ref}$ that have been determined for optimal energy efficiency. Alternate variables may also be selected for performance.

In some embodiments, constraints 167 that can be enforced on control inputs including maximum and minimum actuator values ($CF_{max}$ and $CF_{min}$, $ODF_{max}$ and $ODF_{min}$, etc.) and actuator rate limits ($\Delta CF_{max}$/s, $\Delta ODF_{max}$/s, etc.). Constraints on plant outputs may also be enforced, including maximum compressor discharge temperature $Td_{max}$, minimum evaporating temperature $Te_{min}$, and maximum condensing temperature $Tc_{max}$, etc. Alternate variables or combinations thereof may also be used for constraints.

The reconfigurable controller 200 employing the principles of different embodiments stabilizes and achieves these objectives for each configuration of the system, and thus stability, reference tracking, disturbance rejection and constraint enforcement can occur for every combination of heat exchangers that are active or inactive. To achieve these control objectives, a controller is developed based on a realized structure of a model of the MZ-VCS. This structure in the model leads to a structured formulation of a constrained optimization problem that can be parameterized by the system configuration $\zeta$ and used to automatically generate optimization problems specific to the system configuration. The structured plant model is described next.

Structure of MZ-VCS Model

Some embodiments of the invention are based on appreciation of the physics governing the operation of the MZ-VCS that reveals a chain of causality leading to a particular structure in the model equations. Specifically, each zone temperature depends on the local heat load and the temperature of the corresponding heat exchanger. In addition, the central components of the MZ-VCS that include the compressor and outdoor unit heat exchanger affect each of the heat exchangers. However, heat exchangers are not mutually coupled. That is, changes in one heat exchanger do not directly affect another heat exchanger.

When the set of differential equations describing this system from the control inputs to the measurements are written in matrix form, the representation reveals a particular pattern of zero-valued and non-zero-valued elements that create an advantageous structure. Specifically, this disclosure uses subscript 0 to denote non-repeated components of the vapor compression system (e.g., the compressor, outdoor unit heat exchanger and associated fan), which is referred to as the "centralized subsystem" and can be described a linear time-invariant (LTI) model:

$$x_{e_0}(t+1)=A_{e_{00}}x_{e_0}(t)+\Sigma_{i=0}^{N}B_{e_{0i}}u_{e_i}(t), \tag{1}$$

$$z_{e_0}(t)=E_{e_0}x_{e_0}(t), y_{e_0}(t)=C_{e_0}x_{e_0}(t). \tag{2}$$

Also, the disclosure uses the subscript $i\in\{1, \ldots, N\}$ to denote i-th zone dynamics (principally the dynamics associated with each heat exchanger and associated zone air, including the linearizing effect of the capacity controllers), which is referred to as the "decentralized subsystems" and can be described as a set of LTI models:

$$x_{e_i}(t+1)=A_{e_{ii}}x_{e_i}(t)+A_{e_{i0}}x_{e_0}(t)+\Sigma_{j=0}^{N}B_{e_{ij}}u_{e_i}(t), \tag{3}$$

$$z_{e_i}(t)=E_{e_i}x_{e_i}(t), \forall i=1, \ldots, N, \tag{4}$$

where $$x_{e_i} \in^{n_{e_i}}, u_{e_i} \in^{m_{e_i}}, z_{e_i} \in^{p_{e_i}},$$

for $i \in \{0, 1, \ldots, N\}$ represent the states, control inputs and performance outputs, respectively and $$y_{e_0} \in^{s_{e_0}}$$

represents me constrained outputs of the centralized system.

As follows from the model equations (1) and (3), the evolution of the decentralized subsystems depends on the state of the centralized dynamics. On the other hand, the evolution of the centralized dynamics is independent of the states of the decentralized subsystems. This structure reflects the physical interactions between the vapor compression system and the air temperatures in local zones: each zone temperature depends on the local heat load and the states of the corresponding heat exchanger. On the other hand, due to the negligible impact of air temperature on the local heat exchanger, the centralized states are independent from the decentralized ones. As a result of this structure, the composite $A_e$ matrix of the system $$A_e = \begin{bmatrix} A_{e_{00}} & & & \\ A_{e_{10}} & A_{e_{11}} & & \\ \vdots & & \ddots & \\ A_{e_{N0}} & & & A_{e_{NN}} \end{bmatrix},$$

is lower block triangular with (i,j)-th block $A_{e_{i,j}}=0$ when $i \neq j$ and $i>0$.

The evolution of both the centralized and decentralized dynamics are affected by each of the inputs. The centralized control inputs (CF and ODF) influence the cooling capacities ($CCC_i$) and hence the temperature dynamics in each zone, while the decentralized control inputs ($CCC_i$) affect the centralized dynamics of the refrigerant systems. Due to this coupling the $B_e$ matrix of the system $$B_e = \begin{bmatrix} B_{e_{00}} & B_{e_{01}} & \cdots & B_{e_{0N}} \\ B_{e_{10}} & B_{e_{11}} & \cdots & B_{e_{1N}} \\ \vdots & \vdots & \ddots & \vdots \\ B_{e_{N0}} & B_{e_{N1}} & \cdots & B_{e_{NN}} \end{bmatrix},$$

does not have any particular structure. The present invention exploits this model structure to formulate an optimization problem using control parameters that can be parameterized by the configuration signal $\zeta$. Then, given a particular configuration, an optimization problem suitable for any instance of heat exchangers that are active or inactive can be automatically obtained by suitable modifications to the control parameters. The structured optimization problem and modifications performed to the control parameters are described below.

Formulating the Prediction Model

Some embodiments augment the model (1) and (3) to formulate a prediction model that incorporates disturbances, additional constraints and reference set-points into the recursive prediction and optimization. First, the model can be augmented with auxiliary states so that the prediction model accurately predicts the effect of control decisions on the constrained and performance outputs, $$y_{e_0}(t) = C_{e_0} x_{e_0}(t) + C_{w_{e_0}} w_{e_0}(t), \tag{5}$$

$$z_{e_i}(t) = E_{e_i} x_{e_i}(t) + E_{w_{e_i}} w_{e_i}(t), \quad \forall\, i = 0, \ldots, N, \tag{6}$$

where $w_{e_i}$ denotes the auxiliary offset states for each subsystem that are constant over the prediction horizon, $w_{e_i}(t+1)=w_{e_i}(t)$. The inclusion of these offset states accounts for unmeasured disturbances and modeling errors in the prediction model.

A second augmentation involves expressing the input as a change from a previous value:

$$x_{u_i}(t+1)=x_{u_i}(t)+\Delta u_i(t), \forall i=0, \ldots, N, \tag{7}$$

where $x_{u_i}(t):=u_{e_i}(t-1)$. This change of variables enables input constraints to be placed on the rate of change of the control input $\Delta u_i$ and on the actuator positions $x_{u_i}$. Moreover, the second augmentation can help to ensure that the steady state input $\Delta u_i$ is zero when tracking a constant reference under constant disturbances.

Additionally, a state vector may be augmented with the reference signals, i.e., the setpoints for the compressor discharge temperature and the zone temperatures. In particular, the set-point is obtained from an exogenous source and assumed to be constant over the prediction horizon, i.e., $r_i(t+1)=r_i(t)$, $i=0, \ldots, N$. Also, integrators may be included on the zone temperature tracking errors $$\xi_i(t+1)=\xi_i(t)+T_s(r_i(t)-z_{e_i}(t)), \forall i=1, \ldots, N, \tag{8}$$

to achieve zero steady state tracking error in the presence of uncertainties in zone volume and heat loads. Adding integrators to the prediction model, and including them as part of the performance outputs penalized in the cost function provides an opportunity for tuning the associated entries in the control parameters to achieve faster offset-free zone temperature responses.

By augmenting the prediction model in the manner described, the cost function is designed to minimize the tracking error and integrated error between the measured and desired values of the performance outputs, thus the performance output is redefined as $z_0:=r_0-z_{e_0}$ for the centralized subsystem. Moreover, the constrained output is augmented as $y_0:=(y_{e_0}, x_{u_0}, \Delta u_0)$ to account for the limits on the control input and actuator rate. Further, define the exogenous input $w_0:=(w_{e_0}, r_0)$ and the augmented state $x_0:=(x_{e_0}, x_{u_0})$, and the prediction model of the centralized subsystem can be written as $$w_0(t+1)=w_0(t) \tag{9}$$

$$x_0(t+1)=A_{00}x_0(t)+\Sigma_{i=0}^{N}B_{0i}x_{u_i}(t)+\Sigma_{i=0}^{N}B_{0i}\Delta u_i(t) \tag{10}$$

$$z_0(t)=E_0x_0(t)+E_{w_0}w_0(t), \tag{11}$$

$$y_0(t)=C_0x_0(t)+C_{w_0}w_0(t)+D_0\Delta u_0(t). \tag{12}$$

Similarly, define $w_i:=(w_{e_i}, r_i)$, $x_i:=(x_{e_i}, x_{u_i})$, $z_i:=(r_i-z_{e_i}, \xi_i)$ and $y_i:=(x_{u_i}, \Delta u_i)$ as the exogenous inputs, states, performance and constrained outputs for the decentralized subsystems respectively, and the prediction model of the decentralized subsystems is written as $$w_i(t+1)=w_i(t) \tag{13}$$

$$x_i(t+1)=A_{ii}x_i(t)+A_{i0}x_0(t)+G_iw_i(t)+\Sigma_{j=0}^{N}B_{ij}x_{u_j}(t)+\Sigma_{j=0}^{N}B_{ij}\Delta u_j(t) \tag{14}$$

$$z_i(t)=E_ix_i(t)+E_{w_i}w_i(t), \forall i \in, \tag{15}$$

$$y_i(t)=C_ix_i(t)+C_{w_i}w_i(t)+D_i\Delta u_0(t). \tag{16}$$

Although the actuator positions $x_{u_i}$ are a subset of the augmented state $x_i$, the state $x_{u_i}$ has been pulled out of (9)-(13) and can be expressed as $x_{u_i}=\Omega_i x_i$. As described later, this allows for monitoring the actuator positions separately as the system is reconfigured, hence maintaining the overall model structure. Finally, the subsystem models are combined by defining $w:=(w_0, \ldots, w_N)$, $x:=(x_0, \ldots, x_N)$, $x_u:=(x_{u_0}, \ldots, x_{u_N})$, $\Delta u:=(\Delta u_0, \ldots, \Delta u_N)$, $z=(z_0, \ldots, z_N)$ and $y=(y_0, \ldots, y_N)$, resulting in a prediction model for the overall system:

$$\begin{bmatrix} w(t+1) \\ x(t+1) \end{bmatrix} = \underbrace{\begin{bmatrix} I & 0 \\ G & A \end{bmatrix}}_{A_a} \begin{bmatrix} w(t) \\ x(t) \end{bmatrix} + \underbrace{\begin{bmatrix} 0 \\ B \end{bmatrix}}_{B_a} \Delta u(t), \tag{17}$$

$$y(t) = \underbrace{[\, C_w \quad C \,]}_{C_a} \begin{bmatrix} w(t) \\ x(t) \end{bmatrix} + D\Delta u(t), \tag{18}$$

$$z(t) = \underbrace{[\, E_w \quad E \,]}_{E_a} \begin{bmatrix} w(t) \\ x(t) \end{bmatrix}. \tag{19}$$

where $w\in^q$, $x\in^n$, $\Delta u\in^m$, $z\in^p$, $y\in^w$ are such that $q:=\Sigma_{i=0}^n q_i$, $n:=\Sigma_{i=0}^n n_i$, $m:=\Sigma_{i=0}^n m_i$, $p:=\Sigma_{i=0}^n p_i$, $w:=\Sigma_{i=0}^n w_i$, and $x_a(t):=(w(t), x(t))$ defines the overall state of the prediction model, where w(t) represent the exogenous signals (i.e., reference, disturbance and so on) that are not controllable.

Moreover, the augmented model (A, B) is controllable if the original plant model $(A_e, B_e)$ is controllable. The composite system matrices can be calculated from (9) and (13), and have the following form:

$$A = \begin{bmatrix} A_{00} & & & \\ A_{10} & A_{11} & & \\ \vdots & & \ddots & \\ A_{N0} & & & A_{NN} \end{bmatrix} + \begin{bmatrix} B_{00} & B_{01} & \ldots & B_{0N} \\ B_{10} & B_{11} & \ldots & B_{1N} \\ \vdots & \vdots & \ddots & \vdots \\ B_{N0} & B_{N1} & \ldots & B_{NN} \end{bmatrix} \begin{bmatrix} \Omega_0 & & & \\ & \Omega_1 & & \\ & & \ddots & \\ & & & \Omega_N \end{bmatrix}, \tag{20}$$

$$G = \begin{bmatrix} 0 & & & \\ & G_1 & & \\ & & \ddots & \\ & & & G_N \end{bmatrix}$$

$$B = \begin{bmatrix} B_{00} & \ldots & B_{0N} \\ \vdots & \ddots & \vdots \\ B_{N0} & \ldots & B_{NN} \end{bmatrix}, E = \begin{bmatrix} E_0 & & \\ & \ddots & \\ & & E_N \end{bmatrix}, E_w = \begin{bmatrix} E_{w_0} & & \\ & \ddots & \\ & & E_{w_N} \end{bmatrix} \tag{21}$$

$$C = \begin{bmatrix} C_0 & & \\ & \ddots & \\ & & C_N \end{bmatrix}, C_w = \begin{bmatrix} C_{w_0} & & \\ & \ddots & \\ & & C_{w_N} \end{bmatrix}, D = \begin{bmatrix} D_0 & & \\ & \ddots & \\ & & D_N \end{bmatrix}, \tag{22}$$

Although the composite state matrix A is not lower block triangular, the composite state matrix A has the structure $A:=A_0+B\Omega$ where $A_0$ is lower block triangular and $\Omega$ is block diagonal. Some embodiments exploit this structure to design the reconfigurable controller 200.

Structured Control Formulation

An optimization problem solved by a controller designed according to the principles of MPC determines the actuator commands that minimize a cost function subject to the system dynamics and constraints. From the formulation of this optimization problem, a transformation is applied to generate an expression of this problem that is suitable for online execution. In the case where the cost function includes only quadratic penalties on the states (or outputs) and inputs, and the constraints depend linearly on the states, outputs and/or inputs, then the transformation results in a "quadratic program" for which well-known algorithms exist. Some embodiments of the present invention solve a quadratic program in order to compute actuator commands that minimize the cost and enforce constraints.

For the MZ-VCS allowing the heat exchangers to activate or deactivate, the number of inputs and outputs change for each configuration, requiring a different optimization problem for each configuration. However, by exploiting the model structure of the MZ-VCS previously described, a single formulation of the optimization problem can be obtained wherein the control parameters in cost function are created to have a structure that corresponds to the structure of the model of the MZ-VCS.

Specifically, consider the MPC problem formulation given by $$\min_{U(k)} x_a(N_m|k)'T'PTx_a(N_m|k) + \sum_{i=0}^{N_m-1} z(i|k)'Qz(i|k) + \Delta u(i|k)'R\Delta u(i|k) \tag{23}$$

$$\text{s.t. } x_a(i+1|k) = A_a x_a(i|k) + B_a \Delta u(i|k) \tag{24}$$

$$y(i|k) = C_a x_a(i|k) + D\Delta u(i|k) \tag{25}$$

$$z(i|k) = E_a x_a(i|k) \tag{26}$$

$$\Delta u_{min} \le \Delta u(i|k) \le \Delta u_{max} \tag{27}$$

$$y_{min} \le y(i|k) \le y_{max} \tag{28}$$

$$x_a(0|k) = x_a(k). \tag{29}$$

The optimization problem is formulated in discrete time with a sample period $T_s$, and at every timestep k, the solution to this problem is a sequence of control inputs $\overline{U}(k)$ over the next $N_m$ steps, called the prediction horizon. In a typical MPC approach, the first action $\overline{U}(0)$ encoded in this solution is applied to the MZ-VCS, and after the sampling period has elapsed, the optimization problem is recomputed using a new prediction horizon of the same length shifted in time by one step. In this manner, MPC is said to be a receding-horizon optimal controller.

At timestep k, the state of the MZ-VCS is obtained, providing the initial condition for the optimization problem $x_a(0|k)$. A prediction model (24)-(26) is created based on (17) and used to encode the MZ-VCS dynamics into the optimization problem, provide a set of performance outputs z to be penalized in the cost function (23) and a set of constrained outputs y to be constrained as part of the optimization problem. The performance outputs can include error signals indicative of the difference between a measured zone temperature and a zone temperature setpoint. The constrained outputs may be measurements, actuator values, or virtual signals created from these performance outputs.

In one embodiments, the cost function (23) includes quadratic penalties z'Qz on the performance outputs (where $z\in^p$ is a vector of performance outputs, Q is a diagonal matrix of dimension p×p whose elements penalize the corresponding performance outputs, and where the quadratic term z'Qz results in a scalar value). Similarly, the cost includes quadratic penalties u'Ru on the control inputs (where $u \in^m$ is a vector of performance outputs, R is a diagonal matrix of dimension m×m whose elements penalize the corresponding control inputs, and where the quadratic term u'Ru results in a scalar value). These performance output and control input penalties are computed at each timestep i over the prediction horizon. Additionally, a so-called terminal cost (applied only at the end of the prediction horizon, $i=N_m$) is included and penalizes the predicted terminal state of the MZ-VCS. The terminal cost is also a quadratic penalty consisting of the predicted state $x_a \in^{n+q}$ at timestep $N_m$ multiplied by a (n+q)×(n+q) terminal penalty matrix T'PT, where T is a transformation matrix of dimension n×(n+q) such that $Tx_a$ shifts the states from steady state solution and P is a diagonal matrix of dimension n×n whose elements penalize the corresponding states. Linear constraints may also be included on the control inputs (27) or on the constrained outputs (28).

The desired transient performance of the closed loop system is encoded by using the elements of the controller parameters Q and R as penalties that indicate the relative importance of tracking a particular performance output or using a particular control input to achieve the control objectives. Consequently, determining the entries of the penalty matrices are critical to the machine performance and must typically be obtained by a trial-and-error tuning process. The entries of the controller parameter P is computed to ensure that the resulting closed loop system is stable, which supports the design of the reconfigurable MPC.

When the MZ-VCS is reconfigured, the numbers of inputs u, performance outputs z, and states x are changed, requiring a new formulation of the optimization problem. However, by exploiting the model structure previously described, a cost function can be obtained that permits automatic reformulation to the appropriate configuration by manipulating the controller parameters Q, R, and P in the cost function. Recall that the system configuration is formally defined as $\zeta(k):=(\zeta_0(k), \ldots, \zeta_N(k))$ which is a vector that indicates whether zone i is active ($\zeta_i(k)=1$) or inactive ($\zeta_i(k)=0$) at timestep k. Since the centralized subsystem is always on unless the entire machine is turned off, we assign $\zeta_0(t):\rightarrow\{1\}$ for consistent notation.

By arranging the model so that performance outputs, control inputs and states are grouped according to the associated heat exchangers using equations (1) and (3), a corresponding structure may be created in the performance penalty Q, the control penalty R, and the terminal cost P. These structured control parameters are then modified based on the given system configuration $\zeta(k)$ as described in the next section.

Reconfigurable MPC Using Quadratic Program

Figure 3A:
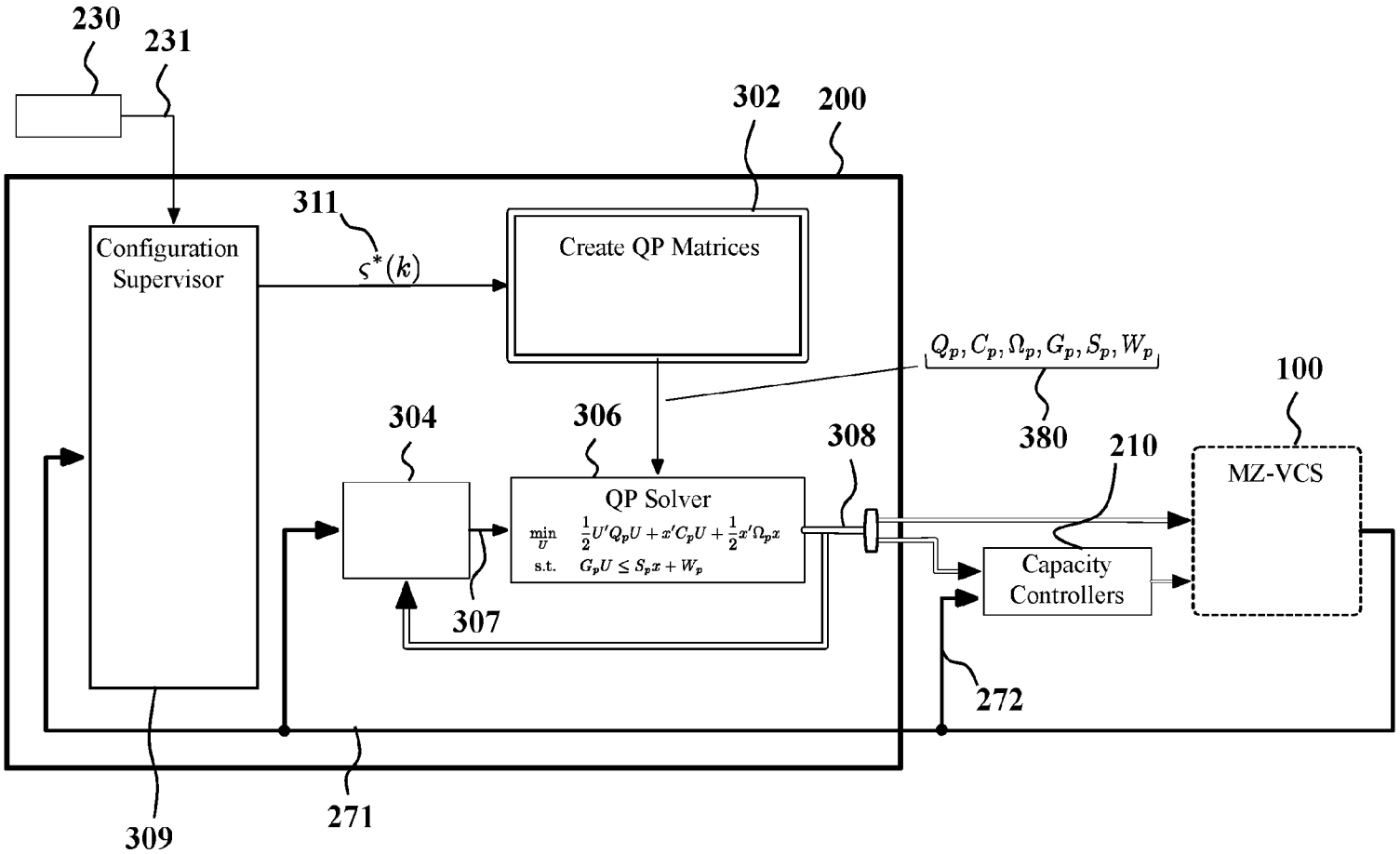
FIG. 3A is a block diagram of a reconfigurable controller for controlling the MZ-VCS according to some embodiments of the invention.

FIG. 3A shows a block diagram of a reconfigurable controller 200 for an MZ-VCS 100 according to some embodiments of the invention that use quadratic program (QP) matrices for determining the control inputs consistent with a reconfigurable MPC approach.

A configuration supervisor module 301 uses sensor information 271 from the MZ-VCS and signals 231 from occupants indicative of desired heat exchanger activation and zone temperature setpoints and determines the appropriate system configuration $\zeta(k)$ 311 at timestep k. This system configuration is provided to a module configured to determine a set QP matrices 380 appropriate for the particular system configuration, where the QP matrices are associated with a constrained optimization problem. The QP matrices are provided to a QP solver module 306 configured to solve a quadratic program. The QP solver module also receives a signal 307 indicative of a state of the MZ-VCS and determined by a state estimator module 304. The state estimator module receives sensor information from the MZ-VCS and the current set of actuator commands 308 to determine the state estimate.

Figure 3B:
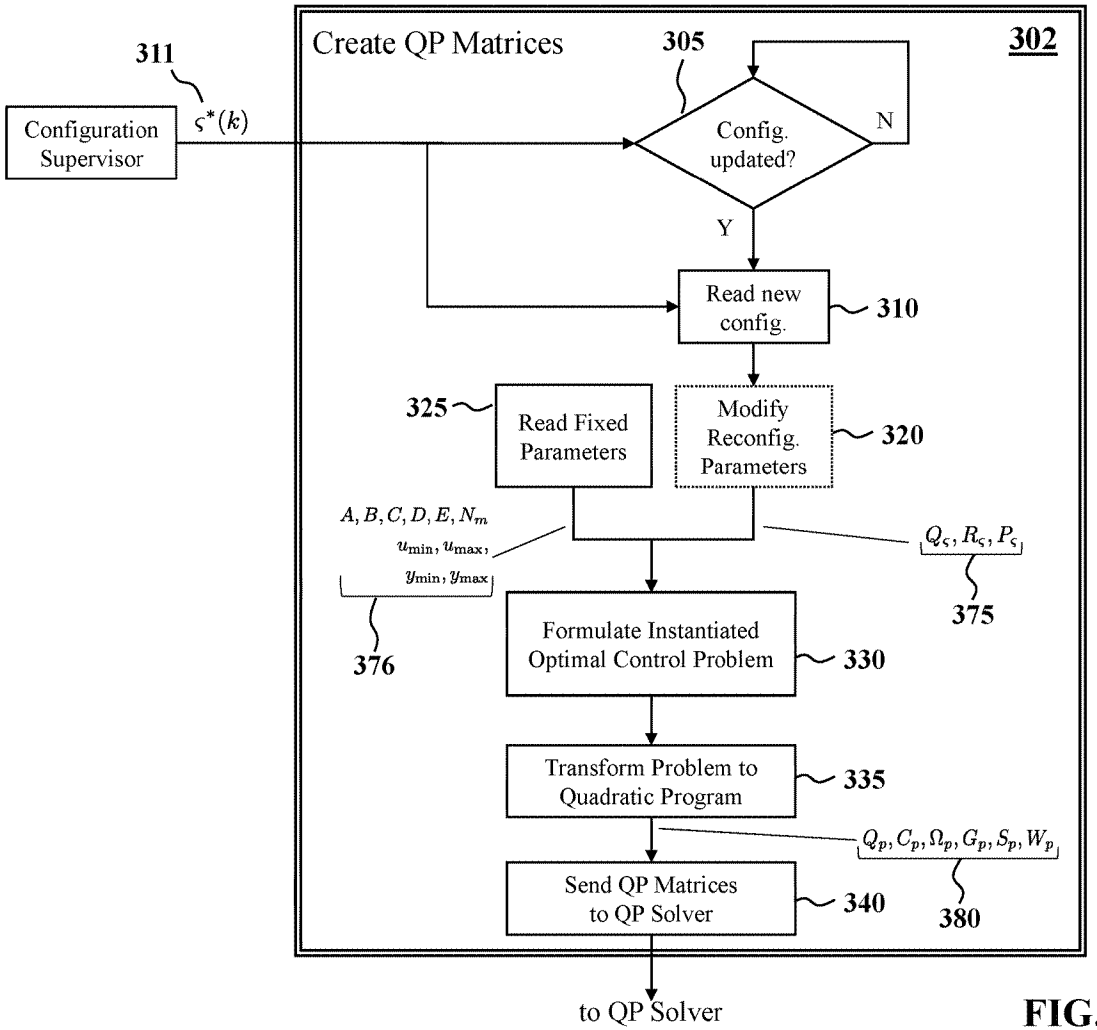
FIGS. 3B and 3C are flow charts of methods for determining control parameters appropriate for an example configuration according to one embodiment of the invention.

FIG. 3B shows a flow chart of a method for determining QP matrices 380 according to some embodiments. The steps of the method can be performed by a processor, such as the processor 185. Referring to FIG. 3B, the system configuration is monitored 305 for changes, and if a change in configuration has been determined, the new configuration is read 310. The system configuration $\zeta(k)$ is provided to a module that modifies the reconfigurable controller parameters 320. The reconfigurable control parameters are the structured performance penalty matrix Q 350, the structured control penalty matrix R 351, and the structured terminal cost matrix P 352. These matrices are computed before any reconfiguration has occurred, and may be computed offline as part of a controller design and tuning process. Determining the values of these reconfigurable control parameters will be described in a subsequent section.

Figure 3C:
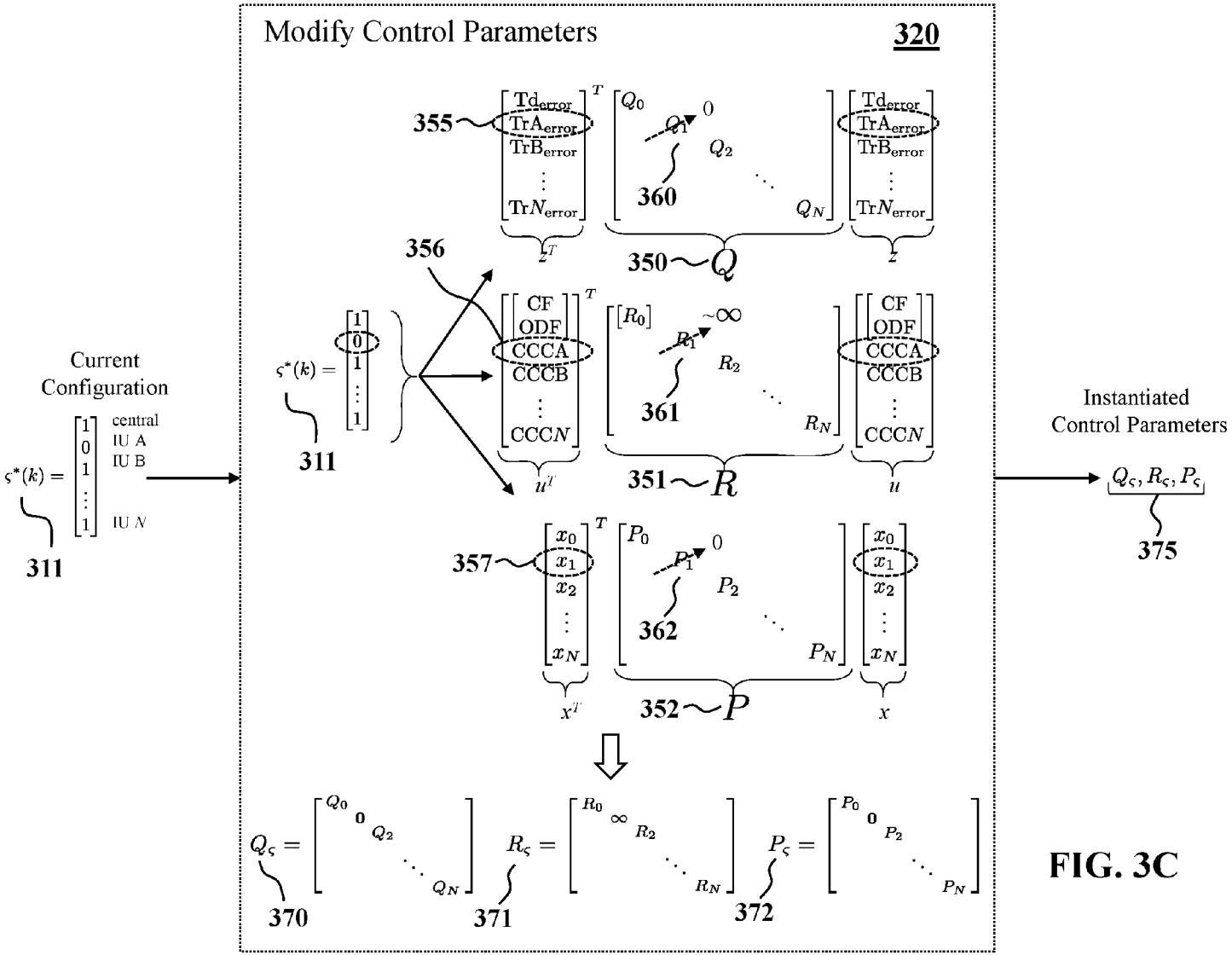

FIG. 3C shows a flow chart of a method for modifying reconfigurable parameters labeled as a box 320 in FIG. 3B. Referring FIG. 3C, the configuration signal $\zeta(k)$ is used to modify the reconfigurable controller parameters Q, R and P to obtain the modified controller parameters $Q_\zeta$, $R_\zeta$, and $P_\zeta$ 375. For the heat exchangers that are deactivated (indicated by a zero-valued element in the corresponding entry of $\zeta(k)$), the corresponding performance variable(s) 355 should not be considered in the instantiated optimal control problem to be created. Therefore, the penalty corresponding to this performance variable 360 is replaced with a zero, and therefore the resulting controller has no incentive to reduce the associated error signal, hence it is effectively removed from the optimization problem. In the case that multiple performance variables are associated with a heat exchanger (for example, it may be desired to use both the zone temperature tracking error and the integral of the zone temperature tracking error for each zone) then there are multiple entries in Q associated with a single heat exchanger and these entries are replaced with a block of zeros of appropriate dimension. After replacing the associated entries of Q with zeros for every heat exchanger that is deactivated in the specific instance of the configuration signal, the instance of the performance penalty matrix $Q_\zeta$ is obtained. The subscript $\zeta$ indicates a particular instance of a reconfigurable parameter or signal after modification that corresponds to the particular system configuration $\zeta(k)$.

Similarly, the reconfigurable control penalty matrix R is modified using the configuration signal. However, in this case, entires in R that correspond to control inputs associated with a deactivated zone 361 are replaced with very large values. The entry 361 in FIG. 3C indicates that $R_1$ is replaced with ∞. This should be interpreted in practice as a very large penalty relative to the other entries in R. A large value in the corresponding entry of R indicates that the controller should not consider using the corresponding control input as an available degree-of-freedom with which to manipulate the MZ-VCS. Therefore a very large penalty in the corresponding entry in R effectively removes the control input associated with the deactivated heat exchanger from the optimization problem. For example, in one embodiment, the optimization function replaces the values of the block of the control penalty matrix R with values larger than a threshold if the corresponding heat exchanger is in the inactive mode. For example, the threshold can be any number larger than the values initially determined for the control penalty matrix. For example, the threshold can be any number larger than the Hessian used in the optimization problem. For example, the threshold can be any very large number permitted by the memory and approaching ∞.

In some embodiments, there may be more than one control input associated with a heat exchanger (for example both the capacity command ($CCC_i$) and the heat exchanger fan speed ($IDF_i$) may be control inputs associated with a zone). In this case, dimensions R and associated diagonal blocks are determined for compatibility. After replacing the associated entries of R with very large values for every heat exchanger that is deactivated in the specific instance of the configuration signal, the instance of the control penalty matrix $R_\zeta$ is obtained.

Finally, the reconfigurable terminal cost matrix P is similarly modified. In this case, entires of P that correspond to states associated with a deactivated zone 362 are replaced with zero-valued elements. Note that the dimension of the state associated with each heat exchanger may be unity or greater, and the corresponding blocks in P will be of suitable dimension to maintain conformability. A zero-valued block in P, indicates that the predicted terminal states associated with a deactivated zone 357 should not be considered in the optimization problem when computing a terminal state that guarantees stability. After replacing the associated entries of P with zeros for every heat exchanger that is deactivated in the specific instance of the configuration signal, the instance of the terminal cost matrix $P_\zeta$ is obtained.

Solving the Instantiated Optimal Control Problem

Referring back to FIG. 3B, the set of the instantiated control parameters $Q_\zeta$, $R_\zeta$, and $P_\zeta$ 375 obtained after modification are then used in conjunction with fixed parameters 376 stored in memory and retrieved 325 to formulate the instantiated optimal control problem 330. The instantiated optimal control problem is the set of equations in (23)-(29) where the instantiated control parameters $Q_\zeta$, $R_\zeta$, and $P_\zeta$ are used in place of the reconfigurable control parameters Q, R, and P. In various embodiments, the modifications performed to the reconfigurable control parameters do not alter their dimensions, i.e., elements within the matrices are replaced with zero-valued terms or very large terms, retaining their original sizes. Because the reconfigurable control parameters retain their dimension, and because the other parameters required to specify the optimal control problem are fixed, every instance of the optimal control problem has a fixed and predetermined dimension. This feature of the invention enables automatic reconfiguration because the optimal control problem does not need to be reformulated—penalties in the cost are modified to produce the effect of removing subsystems while maintaining stability and without formulating a new problem.

One embodiment, in order to compute the solution to the instantiated optimal control problem, a transformation is applied 335 to obtain a set of matrices 380 that represent a quadratic program (QP), and these matrices are sent 340 to a module configured to solve QPs for online execution.

The MPC optimal control problem (23)-(29) can be formulated as a quadratic programming problem $$\min_U U'Q_pU + 2x'C_pU + x'\Omega_p x \tag{30}$$

$$\text{s.t. } G_pU \le S_px + Wp$$

where a Hessian cost matrix $Q_p$, a linear cost matrix $C_p$, a state cost matrix $\Omega_p$, a constraint matrix $G_p$, a state constraint matrix $S_p$, and constraints vector $W_p$ are computed from the parameters of Equations (23)-(29).

For example, one embodiment determines the matrices of Equation (30) by first computing the "batch" dynamics over the $N_m$-step prediction horizon $$X=A_bx_a+B_bU$$

$$Y=C_bX+D_bU \tag{31}$$

where $X=[x_a(0|k), \ldots, x_a(N_m|k]'$ is the predicted augmented state, $U=[\Delta u(0|k), \ldots, \Delta u(N_m-1|k)]'$ is the predicted change in control input, $Y=[y(0|k), \ldots, y(N_m|k)]'$ is the predicted constrained output over the $N_m$-step horizon, $x_a=x_a(0|k)$ is the current augmented state, and the batch matrices are given by $$A_b = \begin{bmatrix} I \\ A^1 \\ A^2 \\ \vdots \\ A_m^N \end{bmatrix} B_b = \begin{bmatrix} 0 & 0 & \ldots & 0 \\ B & 0 & \ldots & 0 \\ AB & B & \ddots & \vdots \\ \vdots & \ddots & \ddots & 0 \\ A^{N_m-1}B & \ldots & AB & B \end{bmatrix}$$

$$C_b = \begin{bmatrix} C_a & & \\ & \ddots & \\ & & C_a \end{bmatrix} D_b = \begin{bmatrix} D & & \\ & \ddots & \\ & & D \end{bmatrix}$$

The batch dynamics matrices $A_b$, $B_b$, $C_b$, and $D_b$ do not depend on the system configuration ζ. The cost (23) of the MPC optimal control problem can be written in terms of the batch dynamics matrices $A_b$, $B_b$, $C_b$, and $D_b$ according to $$(A_bx+B_bU)'Q_b(A_bx+B_bU)+U'R_bU \tag{32}$$

where $Q_b$ and $R_b$ are the batch cost matrices $$Q_b = \begin{bmatrix} E_{a'}Q_\zeta E_a & & & \\ & \ddots & & \\ & & E_{a'}Q_\zeta E_a & \\ & & & T'P_\zeta T \end{bmatrix} R_b = \begin{bmatrix} R_\zeta & & \\ & \ddots & \\ & & R_\zeta \end{bmatrix}$$

where $Q_\zeta$, $R_\zeta$ and $P_\zeta$ are the modified controller parameters 375 corresponding to the configuration ζ. Then the cost matrices of the quadratic programming problem (30) are $$Q_p=R_b+B_b'Q_bB_b$$

$$C_p=2A_b'Q_bB_b$$

$$\Omega_p=A_b'Q_bA_b.$$

The constraint matrices $G_p$, $S_p$, and $W_p$ for the quadratic programming problem (30) are given by $$G_p = \begin{bmatrix} I \\ -I \\ C_bB_b + D_b \\ -C_bB_b - D_b \end{bmatrix}, S_p = \begin{bmatrix} 0 \\ 0 \\ -C_bA_b \\ C_bA_b \end{bmatrix}, W_p = \begin{bmatrix} \Delta u_{max}1_{N_m} \\ -\Delta u_{min}1_{N_m} \\ y_{max}1_{N_m} \\ -y_{min}1_{N_m} \end{bmatrix}$$

where $I_{N_m} \in^{N_m \times N_m}$ is an identity matrix and $1_{N_m} \in^{N_m}$ is a vector of ones.

Some embodiments of the invention are based on the observation that for convex quadratic programming problems, the solution U can be found by solving the dual problem $$\min_{\lambda} \lambda' Q_d \lambda + 2x' C_d \lambda + 2C'_{d0}\lambda + x'\Omega_d x \quad \text{s.t. } \lambda \geq 0 \tag{33}$$

where the dual cost Hessian $Q_d$, the dual state linear cost matrix $C_d$, the dual linear cost vector $C_{d0}$, and the dual state cost matrix $\Omega_d$ are computed from the parameters $Q_p$, $C_p$, $\Omega_p$, $G_p$, $S_p$, and $W_p$ in Equation (30) according to $$Q_d = G_p Q_p^{-1} G_p,$$

$$C_d = S_p + G_p Q_p^{-1} C_p$$

$$C_{d0} = W_p$$

$$\Omega_d = C_p Q_p^{-1} C_p - \Omega_p.$$

The solution of Equation (30) is generated from the solution λ of Equation (33) according to $$U = \Phi\lambda + \Psi x, \tag{34}$$

where the transformation matrices Φ and Ψ are computed from $Q_p$, $C_p$, and $G_p$ according to $$\Phi = Q_p^{-1} G_p,$$

$$\Psi = Q_p^{-1} C_p.$$

Determining the Reconfigurable Control Parameters

This section describes how matrices Q, R, and P are determined by some embodiments of the invention. In general, the process for determining these reconfigurable control parameters is performed in offline calculations and stored in memory accessible by a processor during online execution.

The reconfigurable performance penalty matrix Q and the reconfigurable control penalty matrix R, are determined in a tuning or calibration process. Procedures for tuning these penalty matrices are well known in the field of optimal control and standard approaches may be used here. It is important to note here that the tuning process for determining the entries of Q and R are conducted under the assumption that all heat exchangers are active. That is, the desired transient performance of the closed loop controller is specified through the entires in the penalty matrices for an N-unit MZ-VCS where all zones are active. The automatic reconfiguration process previously described is then applied to modify these matrices for any other configuration.

While it is uncomplicated to create Q and R that are structured corresponding to the MZ-VCS model structure, determining the terminal state penalty matrix is not obvious. Typical methods for computing a terminal penalty matrix produce an unstructured matrix, that is, a matrix with no discernible pattern of elements, and therefore no obvious means are available to modify P so that a stable feedback system is achieved when heat exchangers are deactivated.

Some embodiments are based on realization of a formulation of a linear matrix inequality (LMI) problem that produces a terminal penalty matrix with the desired block diagonal structure that can be subsequently modified in the online reconfiguration process 320. By formulating an appropriate LMI, a structured terminal penalty matrix is created with the desired diagonal structure where the diagonal entries can be associated with particular heat exchangers and replaced with zeros when the associated heat exchangers are deactivated. In this manner, a stable constrained optimal controller can be automatically created for every possible configuration of the MZ-VCS. Details of the LMI problem use to create the structured terminal state penalty matrix are described in the remainder of this section.

Some embodiments of the invention construct the terminal cost $x_a PTx_a = x_a T'PTx_a$ and the structured terminal control $\Delta u = KTx_a$ with the following form $$T = [-\Pi \quad I_q], \tag{35}$$

$$P = \begin{bmatrix} P_0 & & & \\ & P_1 & & \\ & & \ddots & \\ & & & P_N \end{bmatrix}, K = \begin{bmatrix} K_{00} & K_{01} & \dots & K_{0N} \\ & K_{11} & & \\ & & \ddots & \\ & & & K_{NN}, \end{bmatrix}, \tag{36}$$

where $T \in^{n\times(n+q)}$ characterizes a parameterized steady-state solution $x_s = \Pi w_s$ for a given constant exogenous input $w_s$, and $\Pi \in^{n\times q}$ is obtained by solving the following matrix equation:

$$\begin{bmatrix} I_n - A \\ -E \end{bmatrix} \Pi = \begin{bmatrix} G \\ E_w \end{bmatrix} \tag{37}$$

Equation (37) is solvable if rank $$\begin{bmatrix} A - I_n & B \\ E & 0 \end{bmatrix} = n + p.$$

The terminal control matrix K features a structure such that the centralized control input $\Delta u_0$ feeds back the state information from all subsystems, whereas conversely, the decentralized control input $\Delta u_i$, ∀i∈ only feeds back its own state information. The proposed structure will allow blocks of the terminal cost and terminal controller to be zeroed when the corresponding subsystem is turned off.

The terminal cost matrix P and controller matrix K can be determined offline by solving a linear matrix inequality for a master problem when all the decentralized subsystems are active. Some embodiments express the terminal cost matrix P and terminal control matrix K as $P = ^{-1}$ and K=P, where $\in^{n\times n}$ and $\in^{m\times n}$ are of the following form $$= \begin{bmatrix} S_0 & & & \\ & S_1 & & \\ & & \ddots & \\ & & & S_N \end{bmatrix}, = \begin{bmatrix} L_{00} & L_{01} & \dots & L_{0N} \\ & L_{11} & & \\ & & \ddots & \\ & & & L_{NN} \end{bmatrix}, \tag{38}$$

and determined by solving the following linear matrix inequality $$\begin{bmatrix} & (AS+B)^T & \left(Q^{\frac{1}{2}}E\right)^T & \left(R^{\frac{1}{2}}\right)^T \\ (A+B) & S & 0 & 0 \\ Q^{\frac{1}{2}}E & 0 & I & 0 \\ R^{\frac{1}{2}} & 0 & 0 & I \end{bmatrix} \pm 0 \tag{39}$$

$$\varsigma \succ 0. \tag{40}$$

The above-described embodiments of a configuration-dependent block diagonal terminal cost and structured terminal control design enable the user to design P and K by solving linear matrix inequality offline in a computer, deploy the controller parameters into a microprocessor, and reconfigure the controller parameters online through simple matrix operation based on reading the configuration $\zeta$ of the system. Moreover, some embodiments guarantee the reconfigured MPC problem is locally asymptotically stable for any configuration $\zeta$ of the system, and that the modified terminal cost $P_\zeta$ and modified terminal controller $K_\zeta$ satisfy the following matrix inequality $$(A_\zeta+B_\zeta K_\zeta)^T P_\zeta (A_\zeta+B_\zeta K_\zeta)-P_\zeta \leq E^T Q_\zeta E-K_\zeta^T R_\zeta K_\zeta, \tag{41}$$

where $A_\zeta$ and $B_\zeta$ represent the composite system matrices (20) corresponding to configuration $\zeta$, and are calculated by eliminating the columns in input matrix B corresponding to inactive actuators, that is, $$A_\varsigma = A_o + B_\varsigma \Omega, \tag{42}$$

$$B_\varsigma = \begin{bmatrix} B_{00} & B_{01} & \dots & B_{0N} \\ B_{10} & B_{11} & \dots & B_{1N} \\ \vdots & \vdots & \ddots & \vdots \\ B_{N0} & B_{N1} & \dots & B_{NN} \end{bmatrix} \begin{bmatrix} \varsigma_0 I_{m_0} & & & \\ & \varsigma_1 I_{m_1} & & \\ & & \ddots & \\ & & & \varsigma_N I_{m_N} \end{bmatrix}, \tag{43}$$

and $K_\zeta$ is a modified terminal control in which elements corresponding to inactive zones are replaced with zeros and expressed as $$K_\varsigma = \begin{bmatrix} \varsigma_0 K_{00} & \varsigma_0 K_{01} & \dots & \varsigma_0 K_{0N} \\ & \varsigma_1 K_{11} & & \\ & & \ddots & \\ & & & \varsigma_N K_{NN}, \end{bmatrix}, \tag{44}$$

Note that the use of K is for analysis purposes and used to calculate a corresponding terminal cost matrix P that exhibits a particular advantageous structure as shown in Equation (35). However, formulating the instantiated optimal control problem 330 does not require the control parameter K, and therefore a configuration-dependent modification of K is not required. However, the structured cost matrix corresponding to the terminal controller is modified 320 online as previously described.

Configuration Supervisor

Referring to FIG. 3A, a configuration supervisor module 309 determines the appropriate system configuration, that is, the set of heat exchangers that are active and inactive. The configuration supervisor receives signals 231 from occupants that are indicative of the desired active heat exchanger and their respective zone setpoint temperatures. Using this information and with sensor information 271 indicative of the measured zone temperature, the configuration supervisor determines which heat exchangers should be activated so that the zone temperature may be driven toward the zone temperature setpoint.

For example, an occupant may use a user interface module 230 to indicate that a particular zone should be turned on and operate with a particular zone setpoint temperature. Then the configuration supervisor may compare the measured zone temperature with the desired zone temperature in order to determine if the associated heat exchanger should be activated. It may be that the zone is colder than the setpoint temperature and therefore the configuration supervisor may decide to deactivate the heat exchanger. Or, it may be that the zone is warmer than the setpoint temperature and therefore the configuration supervisor may decide to activate the heat exchanger.

A configuration supervisor may deactivate a zone in one of two ways: (1) it may decide that the local conditions are such that the zone no longer requires conditioning, or (2) the occupant may specify that the zone is to be shut off. If the zone is to be shut off while one or more of the other zones remain in service, then the indicated zone is deactivated by the configuration supervisor.

Figure 4:
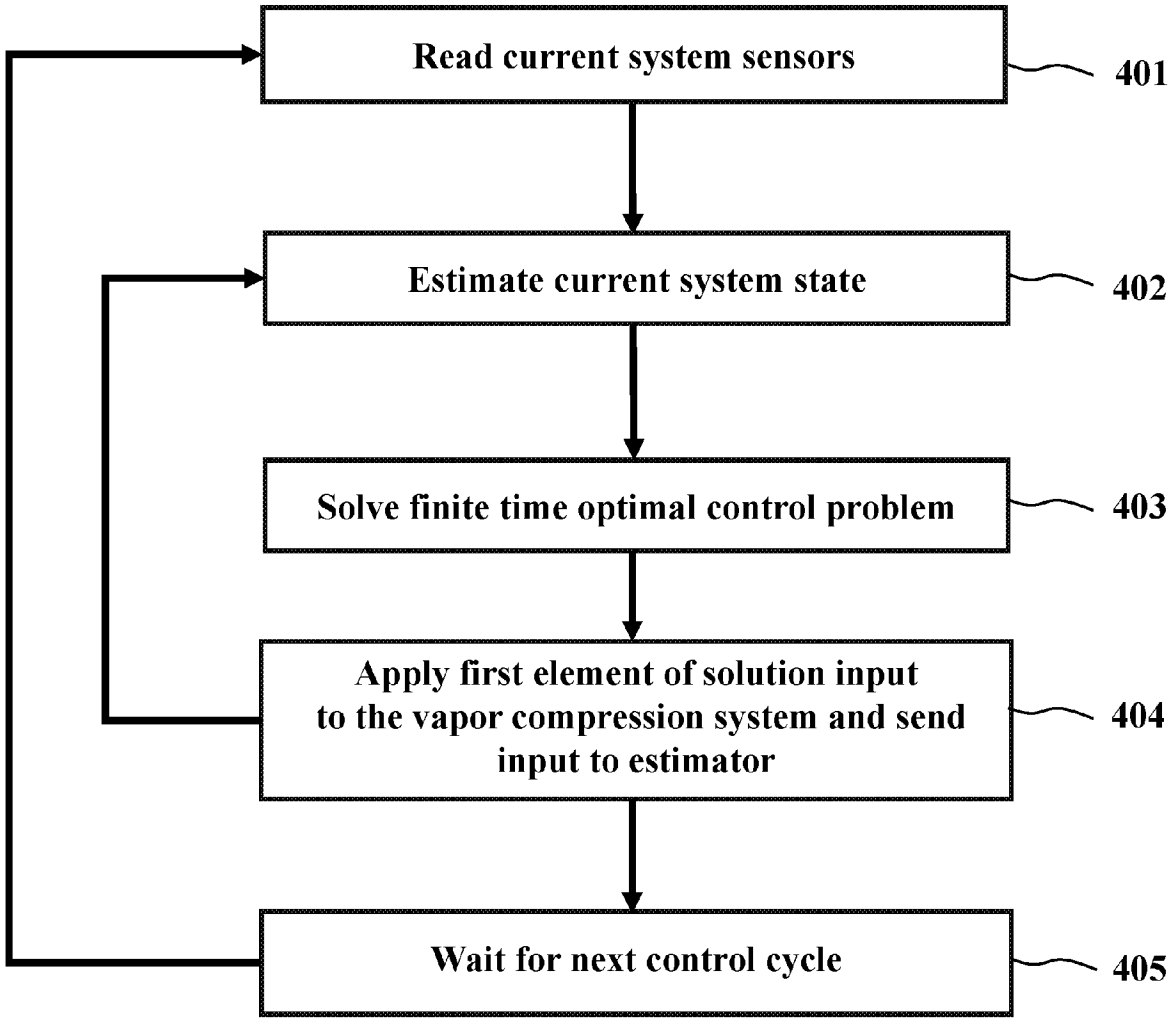
FIG. 4 is a flow chart of a method for model predictive control according to one embodiment of the invention.

FIG. 4 shows a flow chart of a method for model predictive control of the VCS according to one embodiment of the invention. Some embodiments determine 401 the measured outputs, e.g., receives information from the sensors of the MZ-VCS, and estimates 402 the state and configuration of the MZ-VCS. Next, the method solves 403 the constrained finite time optimization problem, applies 404 the first step of that solution to the MZ-VCS and/or capacity controllers, and transitions 405 to the next control cycle.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

The invention claimed is:

1. A system for controlling a multi-zone vapor compression system (MZ-VCS) including a compressor connected to a set of heat exchangers for controlling environments in a set of zones, comprising:

a controller configured to control a vapor compression cycle of the MZ-VCS using a set of control inputs determined by optimizing a cost function including a set of control parameters, wherein the optimizing is subject to constraints, and wherein the cost function is optimized over a prediction horizon;

a memory configured to store an optimization function parameterized by a configuration of the MZ-VCS defining active or inactive modes of each heat exchanger, wherein the optimization function modifies, according to a current configuration, values of the control parameters of the cost function determined for a full configuration that includes all heat exchangers in the active mode, wherein the configuration is a vector having elements with first values for the heat exchangers in the inactive mode and having elements with second values for the heat exchangers in the active mode, wherein an index of the element in the configuration vector matches an index of a corresponding heat exchanger; and a processor configured to determine the current configuration of the MZ-VCS and to update the cost function by submitting the current configuration to the optimization function.

2. The system of claim 1, wherein a structure of the control parameters corresponds to a structure of a model of the MZ-VCS, such that there is a correspondence between control parameters and a heat exchanger in the MZ-VCS, and wherein the optimization function preserves the values of the control parameters if the corresponding heat exchanger is in the active mode and modifies the values of the block if the corresponding heat exchanger is in the inactive mode.

3. The system of claim 1, wherein the control parameters include at least one block diagonal matrix, an index of each block on the diagonal of the matrix matches the index of the corresponding heat exchanger and values of each block on the diagonal of the matrix are determined for the corresponding heat exchanger, wherein the optimization function preserves the values of the block if the corresponding heat exchanger is in the active mode and modifies the values of the block if the corresponding heat exchanger is in the inactive mode.

4. The system of claim 3, wherein the at least one block diagonal matrix include one or a combination of a performance penalty matrix Q whose elements penalize outputs of the MZ-VCS, a control penalty matrix R whose elements penalize control inputs to the MZ-VCS, and a terminal cost matrix P whose elements penalize terminal states of the MZ-VCS.

5. The system of claim 4, wherein the optimization function replaces the values of the blocks of the performance penalty matrix Q and the terminal cost matrix P with zeros if the corresponding heat exchanger is in the inactive mode, and wherein the optimization function replaces the values of the block of the control penalty matrix R with values larger than initial values of the control penalty matrix if the corresponding heat exchanger is in the inactive mode.

6. The system of claim 3, wherein modification of the values of the control parameters preserves the dimension of the block diagonal matrix.

7. The system of claim 1, further comprising:

a set of capacity controllers corresponding to the set of heat exchangers for transforming the set of control parameters into position of valves in the heat exchangers.

8. The system of claim 1, further comprising:

at least one input interface for accepting values of the modes for each heat exchanger in the MZ-VCS, wherein the processor determines the current configuration based on the values of the modes received from the input interface.

9. The system of claim 1, further comprising:

a set of sensors for measuring temperature in the corresponding zones controlled by the MZ-VCS; and at least one input device for setting desired temperature in the corresponding zones, wherein the processors determines the current configuration based on the measurements from the set of sensors and values of the desired temperature.

10. A method for controlling a multi-zone vapor compression system (MZ-VCS) including a compressor connected to a set of heat exchangers for controlling environments in a set of zones, comprising:

determining a current configuration of the MZ-VCS defining active or inactive mode of each heat exchanger in the MZ-VCS;

updating at least some values of control parameters in a cost function by submitting the current configuration to an optimization function parameterized by a configuration of the MZ-VCS, wherein the optimization function modifies values of the control parameters of the cost function according to the current configuration, wherein the control parameters include at least one block diagonal matrix, an index of each block on the diagonal of the matrix matches an index of a corresponding heat exchanger and values of each block on the diagonal of the matrix are determined for the corresponding heat exchanger, wherein the optimization function preserves the values of the block if the corresponding heat exchanger is in the active mode and modifies the values of the block if the corresponding heat exchanger is in the inactive mode; and controlling a vapor compression cycle of the MZ-VCS using a set of control inputs determined by optimizing the cost function subject to constraints, wherein steps of the method are performed using a processor.

11. The method of claim 10, wherein the configuration is a vector having elements with first values for the heat exchangers in the inactive mode and having elements with second values for the heat exchangers in the active mode, wherein an index of the element in the configuration vector matches an index of a corresponding heat exchanger.

12. The method of claim 10, wherein the values of the control parameters are initialized for a full configuration that includes all heat exchangers in the active mode.

13. The method of claim 10, wherein the at least one block diagonal matrix include one or a combination of a performance penalty matrix Q whose elements penalize outputs of the MZ-VCS, a control penalty matrix R whose elements penalize control inputs to the MZ-VCS, and a terminal cost matrix P whose elements penalize states of the MZ-VCS.

14. The method of claim 13, wherein the optimization function replaces the values of the block of the performance penalty matrix Q with zeros when the corresponding heat exchanger is in the inactive mode, wherein the optimization function replaces the values of the block of the terminal cost matrix P with zeros when the corresponding heat exchanger is in the inactive mode, and wherein the optimization function replaces the values of the block of the control penalty matrix R with values larger than other values of the control penalty matrix when the corresponding heat exchanger is in the inactive mode.

15. A non-transitory computer readable storage medium having embodied thereon a program executable by a processor for performing a method, the method comprising:

determining a current configuration of an MZ-VCS defining an active or inactive mode of each heat exchanger in the MZ-VCS;

updating at least some values of control parameters in a cost function by submitting the current configuration to an optimization function parameterized by a configuration of the MZ-VCS, wherein the optimization function modifies values of the control parameters of the cost function according to the current configuration, wherein the configuration is a vector having elements with zero values for the heat exchangers in the inactive mode and having elements with non-zero values for the heat exchangers in the active mode, wherein an index of the element in the configuration vector matches an index of a corresponding heat exchanger, wherein the values of the control parameters are initialized for a full configuration that includes all heat exchangers in the active mode; and controlling a vapor compression cycle of the MZ-VCS using a set of control inputs determined by optimizing the cost function subject to constraints.

16. The medium of claim 15, wherein the control parameters include at least one block diagonal matrix, an index of each block on the diagonal of the matrix matches the index of the corresponding heat exchanger and values of each block on the diagonal of the matrix are determined for the corresponding heat exchanger, wherein the optimization function preserves the values of the block if the corresponding heat exchanger is in the active mode and modifies the values of the block if the corresponding heat exchanger is in the inactive mode.

17. The medium of claim 16, wherein the at least one block diagonal matrix include one or combination of a performance penalty matrix Q whose elements penalize outputs of the MZ-VCS, a control penalty matrix R whose elements penalize control inputs to the MZ-VCS, and a terminal cost matrix P whose elements penalize states of the MZ-VCS, wherein the optimization function replaces the values of the block of the performance penalty matrix Q with zeros when the corresponding heat exchanger is in the inactive mode, wherein the optimization function replaces the values of the block of the terminal cost matrix P with zeros when the corresponding heat exchanger is in the inactive mode, and wherein the optimization function replaces the values of the block of the control penalty matrix R with values greater than a threshold when the corresponding heat exchanger is in the inactive mode.

* * * * *